US010470582B2

(12) United States Patent
Odutayo

(10) Patent No.: US 10,470,582 B2
(45) Date of Patent: Nov. 12, 2019

(54) ADJUSTABLE FURNITURE FRAME SYSTEM

(71) Applicant: 4rmiture & Co, Newark, NJ (US)

(72) Inventor: Ade Odutayo, Newark, NJ (US)

(73) Assignee: 4rmiture & Co, Newark, NJ (US)

( * ) Notice: Subject to any disclaimer, the term of this patent is extended or adjusted under 35 U.S.C. 154(b) by 275 days.

(21) Appl. No.: 15/657,760

(22) Filed: Jul. 24, 2017

(65) Prior Publication Data

US 2018/0055237 A1 Mar. 1, 2018

Related U.S. Application Data

(60) Provisional application No. 62/381,351, filed on Aug. 30, 2016.

(51) Int. Cl.

| | |
|---|---|
| ***A47C 19/04*** | (2006.01) |
| ***A47C 7/00*** | (2006.01) |
| ***A47C 17/04*** | (2006.01) |

(52) U.S. Cl.

CPC ..... *A47C 19/04* (2013.01); *A47C 7/002* (2013.01); *A47C 17/04* (2013.01)

(58) Field of Classification Search

CPC ..... A47C 19/04
USPC ..... 5/181, 183–185, 282.1
See application file for complete search history.

(56) References Cited

U.S. PATENT DOCUMENTS

| | | | | |
|---|---|---|---|---|
| 860,938 | A * | 7/1907 | Stanley et al. | A47C 19/04 5/183 |
| 1,259,022 | A * | 3/1918 | Kean et al. | A47C 19/04 5/183 |
| 2,611,907 | A | 9/1952 | Clerc | |
| 3,638,803 | A | 2/1972 | MacMillan | |
| 4,679,261 | A | 7/1987 | Smith et al. | |
| 4,870,711 | A | 10/1989 | Felix | |
| 5,758,372 | A | 6/1998 | Lopez | |
| 5,996,145 | A | 12/1999 | Taylor et al. | |
| 6,125,484 | A | 10/2000 | Thomson | |

(Continued)

FOREIGN PATENT DOCUMENTS

| | | |
|---|---|---|
| CN | 2334267 Y | 8/1999 |
| CN | 2339067 Y | 9/1999 |

(Continued)

OTHER PUBLICATIONS

International Search Report for PCT/US2017/049279 dated Dec. 21, 2017.

(Continued)

*Primary Examiner* — Fredrick C Conley
(74) *Attorney, Agent, or Firm* — Millen, White, Zelano & Branigan, P.C.; William Nixon

(57) ABSTRACT

A frame system that is adjustable in size and shape is provided with components that move in relation to each other. The frame system uses support rails, side rails, and a center rail to configure the different components to a desired shape and size. Each support rail includes a middle support piece and a pair of adjustable support pieces that move within the middle support piece. Each side rail includes a middle side piece and a pair of adjustable side pieces that move within the middle side piece. The center rail includes a middle center piece and connecting pieces that connect to a slot within each middle support piece. Legs mount the support rails and side rails while the center rail uses a leg piece.

19 Claims, 31 Drawing Sheets

(56) References Cited

U.S. PATENT DOCUMENTS

| | | | | |
|---|---|---|---|---|
| 6,338,172 | B1 | 1/2002 | Taylor et al. | |
| 6,481,033 | B2 | 11/2002 | Fogel | |
| 6,836,912 | B1 | 1/2005 | Morris | |
| 7,155,762 | B2 | 1/2007 | Harrow et al. | |
| 7,631,375 | B2 | 12/2009 | Quintile | |
| 7,644,455 | B2 * | 1/2010 | Chang | A47C 19/04 5/181 |
| 7,861,339 | B2 | 1/2011 | Harrow et al. | |
| 8,402,577 | B2 | 3/2013 | Harrow et al. | |
| 8,898,829 | B1 | 12/2014 | Bartlett et al. | |
| 8,950,817 | B2 | 2/2015 | Iacovoni et al. | |
| 9,198,520 | B2 | 12/2015 | Goldsmith | |
| 2008/0078022 | A1 | 4/2008 | Wecker | |
| 2010/0242171 | A1 | 9/2010 | Polevoy et al. | |
| 2016/0051058 | A1 | 2/2016 | Goldsmith | |

FOREIGN PATENT DOCUMENTS

| | | | |
|---|---|---|---|
| CN | 205493264 | U | 8/2016 |
| EP | 1202653 | B1 | 8/2006 |
| ES | 2129354 | A1 | 6/1999 |

OTHER PUBLICATIONS

English Abstract of CN205493264, Publication dated Aug. 24, 2016.
English Abstract of ES2129354, Publication dated Jun. 1, 1999.
English Abstract of CN2339067, Publication dated Sep. 22, 1999.

* cited by examiner

ADJUSTABLE FURNITURE FRAME SYSTEM

FIELD OF THE INVENTION

The present invention relates to a modular frame system that is adjustable to fit a variety of sizes of furniture.

DESCRIPTION OF THE RELATED ART

Beds and other furniture usually consist of a mattress and a box spring that are supported by a bed support having two longitudinal rails attached to corner posts. A headboard, side board, or other component is attached to the corner posts. Each part of the furniture frame fixed to a size compatible with the mattress or cushion for the furniture. The frame is not adjustable, however, for different sized mattresses or cushions. Many times, the mattress or cushion wears out but the furniture frame is still in good condition. Replacement of the furniture requires purchase of a whole new frame along with the cushion if the cushion is a different size.

In the context of a sleep surface, most surfaces are elevated from the floor. Supports usually are assembled from several rigid struts that ensure that the sleep surface is supported on all edges while the rigid structure is not. In addition, these support structures allow for one to attach a headboard or footboard directly to the frame. In this configuration, the headboard and footboard may be mounted on the rigid support structure. Similarly, the frames for sofas, sectionals, love seats, and the like provide support to elevate the seats or cushions above the floor and provide structure on all edges of the seat.

SUMMARY OF THE INVENTION

The disclosed embodiments provide support for a sleep surface, such as a mattress or box spring, and a modern sofa or sectional frame. There is a need to have these structures morph into using the same structure to support sleep surfaces and furniture and, in the process, allow one the choice of configuration of the frame applicable to the desired modular furniture.

An adjustable modular frame system is disclosed. The adjustable modular frame system includes a pair of first corner supports. Each first corner support includes a pair of rectangular tubes of different lengths connected to a leg. A first rectangular tube is connected to a U-channel insert and a second rectangular tube is connected to a support insert. The adjustable modular frame system also includes a pair of second corner supports. Each second corner support includes a pair of rectangular tubes of different lengths connect to a leg. A first rectangular tube is connected to the support insert. A second rectangular tube is connected to the U-channel insert. The first rectangular tube of the second corner support is longer than the first rectangular tube of the first corner support. The adjustable modular frame system includes pair of T-section supports connected to a center bar having a leg. The pair of T-section supports are connected to the support insert such that each T-section support is coupled to the second rectangular tube of a first corner support and the first rectangular tube of a second corner support. The pair of first corner supports, the pair of second corner supports, and the pair of T-section supports are adjustable in distance from each other using or more additional U-channel inserts or support inserts.

Another adjustable modular frame system also is disclosed. The adjustable modular frame system includes a plurality of legs placed in each corner of the system. The adjustable modular frame system also includes a pair of support rails located opposite each other. Each support rail includes a middle support piece having a channel on a bottom side. The channel is bounded by a bent portion and a flat support portion. The bent portion extends inwardly into the middle support piece. The middle support piece includes a slot located approximately midsection. Each support rail also includes a pair of adjustable support pieces movable within the middle support piece to adjust a length of the support rail. Each adjustable support piece fits into the middle support piece such that a side of the adjustable support piece engages the bent portion of the middle support piece. Each adjustable support includes a flatbar having two holes therein to overlap with a leg of the plurality of legs. The adjustable modular frame system also includes a pair of side rails located opposite each other. Each side rail includes a middle side piece having a lip extending inwardly to the system. The middle side piece includes a channel on a bottom side. Each side rail also includes a pair of adjustable side pieces movable within the middle side piece to adjust a length of the side rail. Each adjustable side piece has a lip extending inwardly to the system and fits into the middle side piece. The pair of adjustable side pieces connects to legs of the plurality of legs. The lip of the middle side piece and the lips of the adjustable side pieces are aligned. The adjustable modular frame system also includes a center rail to connect to the pair of support rails. The center rail includes a middle center piece connected to a leg piece. The center rail also includes a pair of connecting pieces to slidably fit into the middle center piece. Each connecting piece includes a tab on an end opposite the middle center piece. The tab fits into the slot of the middle support piece of the support rail. The pair of connecting pieces move within the middle center piece to adjust a length of the center rail.

Another adjustable modular frame system is disclosed. The adjustable modular frame system includes a pair of support rails. Each support rail has a middle support piece and a pair of adjustable support pieces movable within the middle support piece. Each of the pair of adjustable support pieces fit into a bent portion and a flat support portion of the middle support piece. The adjustable modular frame system also includes a pair of side rails. Each side rail has a middle side piece with a first lip and a pair of adjustable side pieces with second lips. The pair of adjustable side pieces is movable within the middle side piece. The second lips of the pair of adjustable side pieces fit underneath the first lip of the middle side piece. The adjustable modular frame system also includes a center rail having a middle center piece connected to a leg piece and a pair of connecting pieces movable within the middle center piece. Each of the pair of connecting pieces includes a tab to connect to a slot in the middle support piece. The adjustable modular frame system also includes a plurality of legs. Each leg is coupled to an adjustable support piece and an adjustable side piece. The pair of adjustable support pieces and the pair of adjustable side pieces, along with the pair of the connecting pieces are configurable to a desired size.

BRIEF DESCRIPTION OF THE DRAWINGS

Various other features and attendant advantages of the present invention will be more fully appreciated as the same becomes better understood when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

Figure 1A:
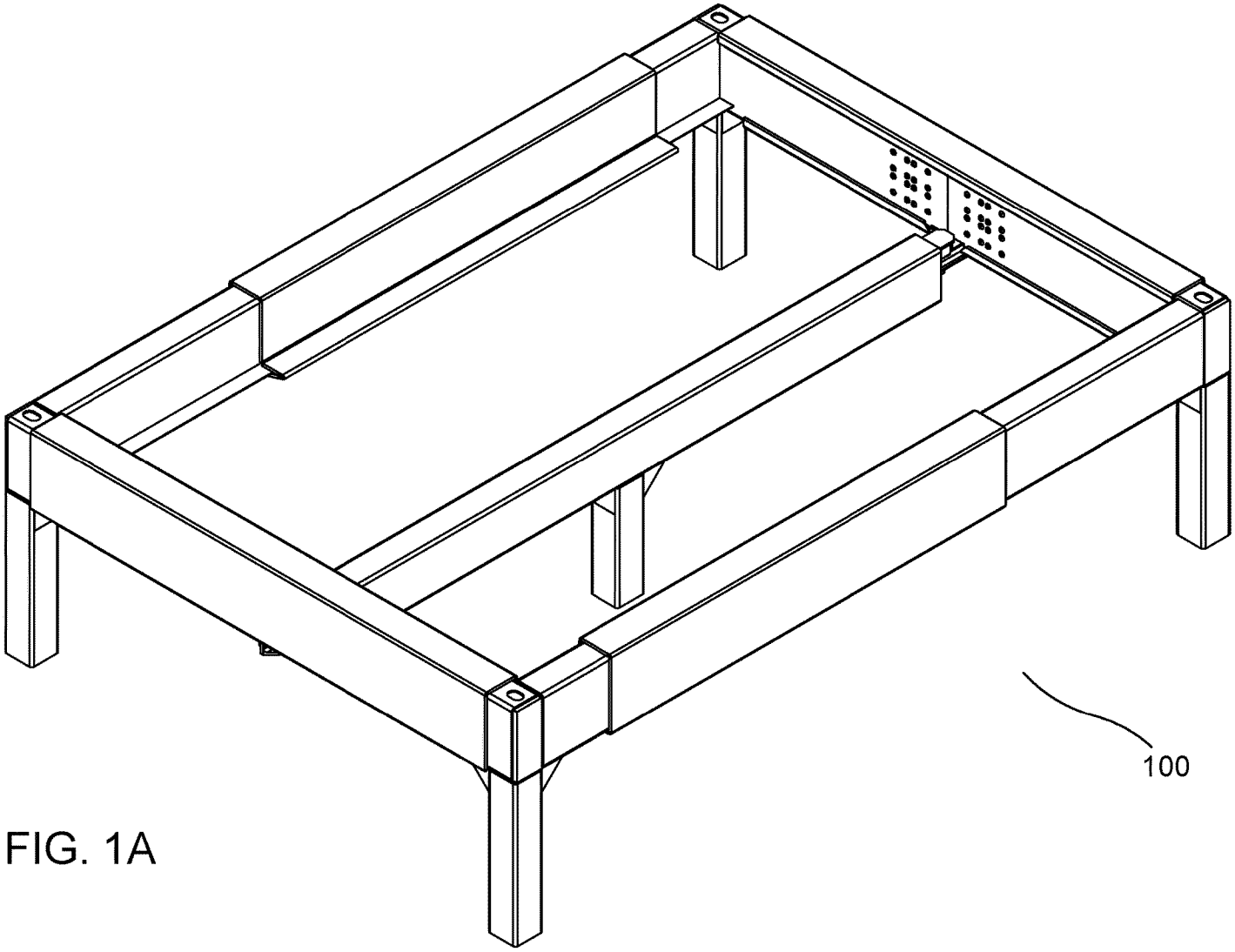
FIG. 1A illustrates a perspective view of an adjustable modular frame system according to the disclosed embodiments.
Figure 1B:
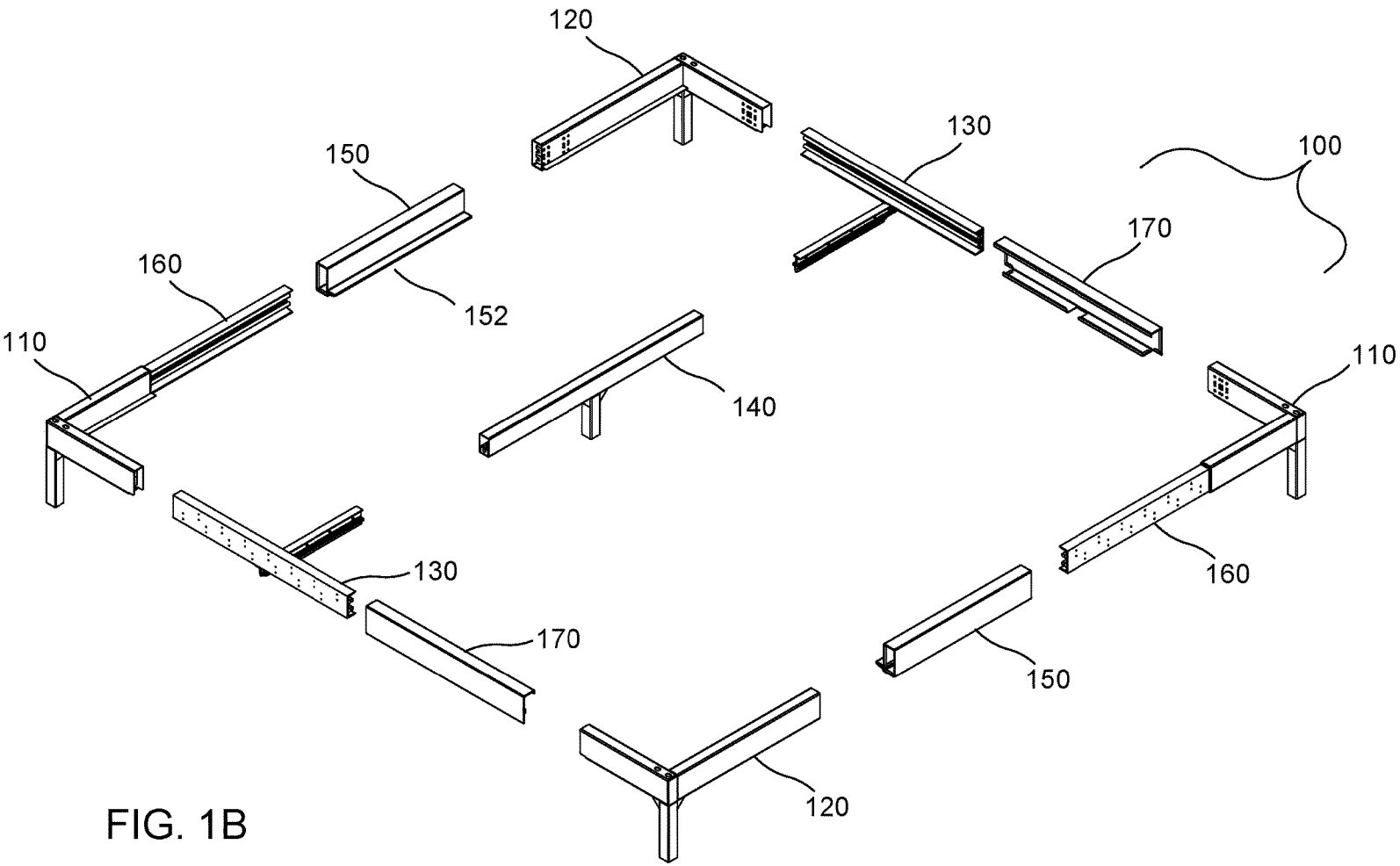
FIG. 1B illustrates an exploded view of the adjustable modular frame system of FIG. 1A according to the disclosed embodiments.
Figure 1C:
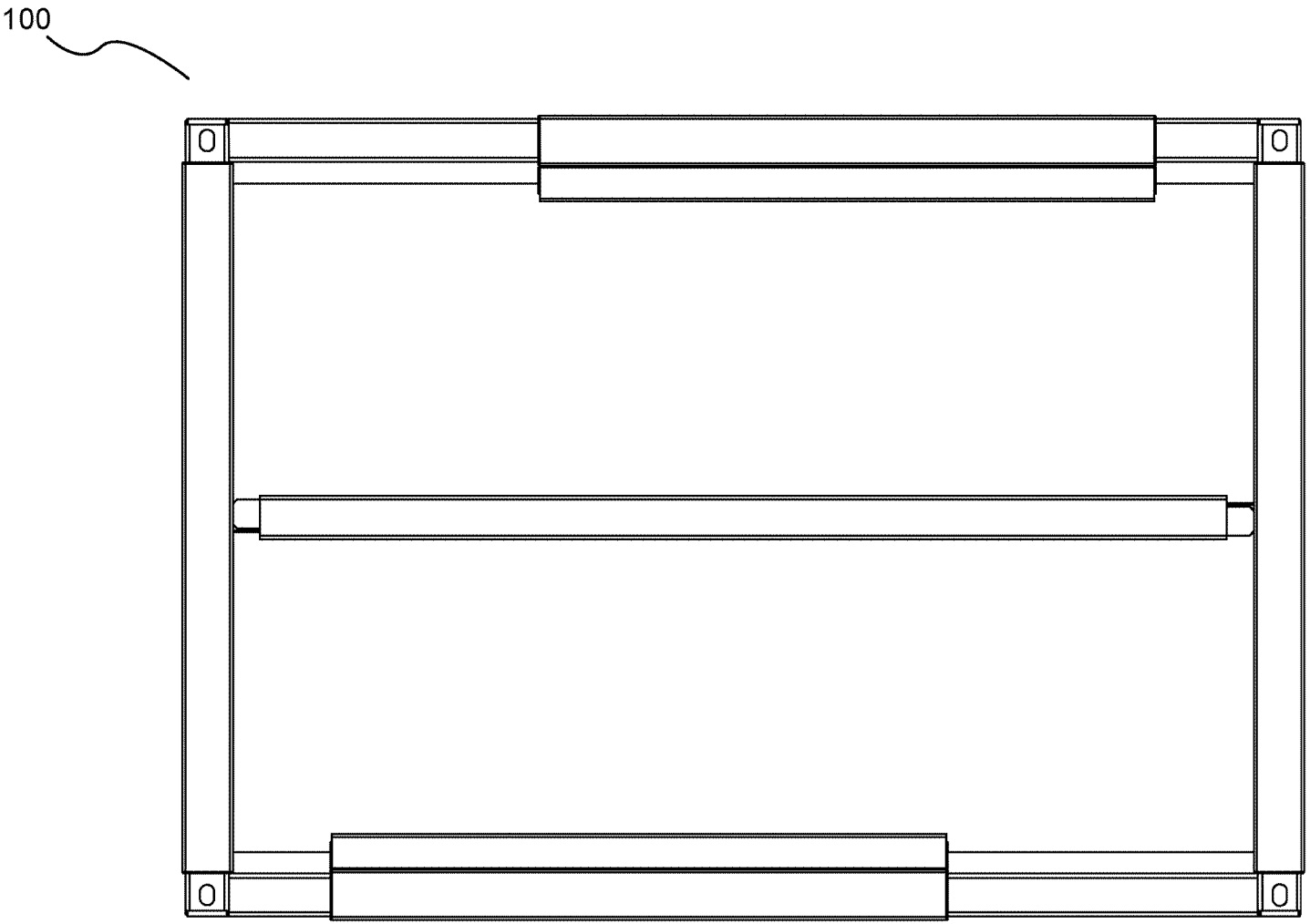
FIG. 1C illustrates a top view of the adjustable modular frame system of FIG. 1A according to the disclosed embodiments.
Figure 1D:
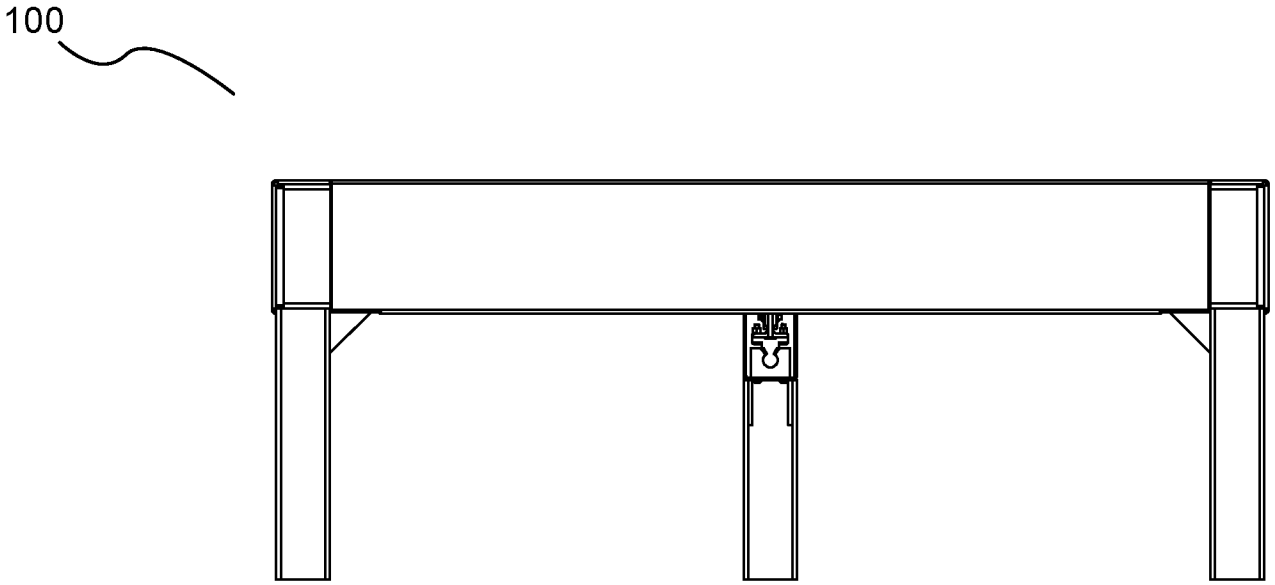
FIG. 1D illustrates a front or back view of the adjustable modular frame system of FIG. 1A according to the disclosed embodiments.
Figure 1E:
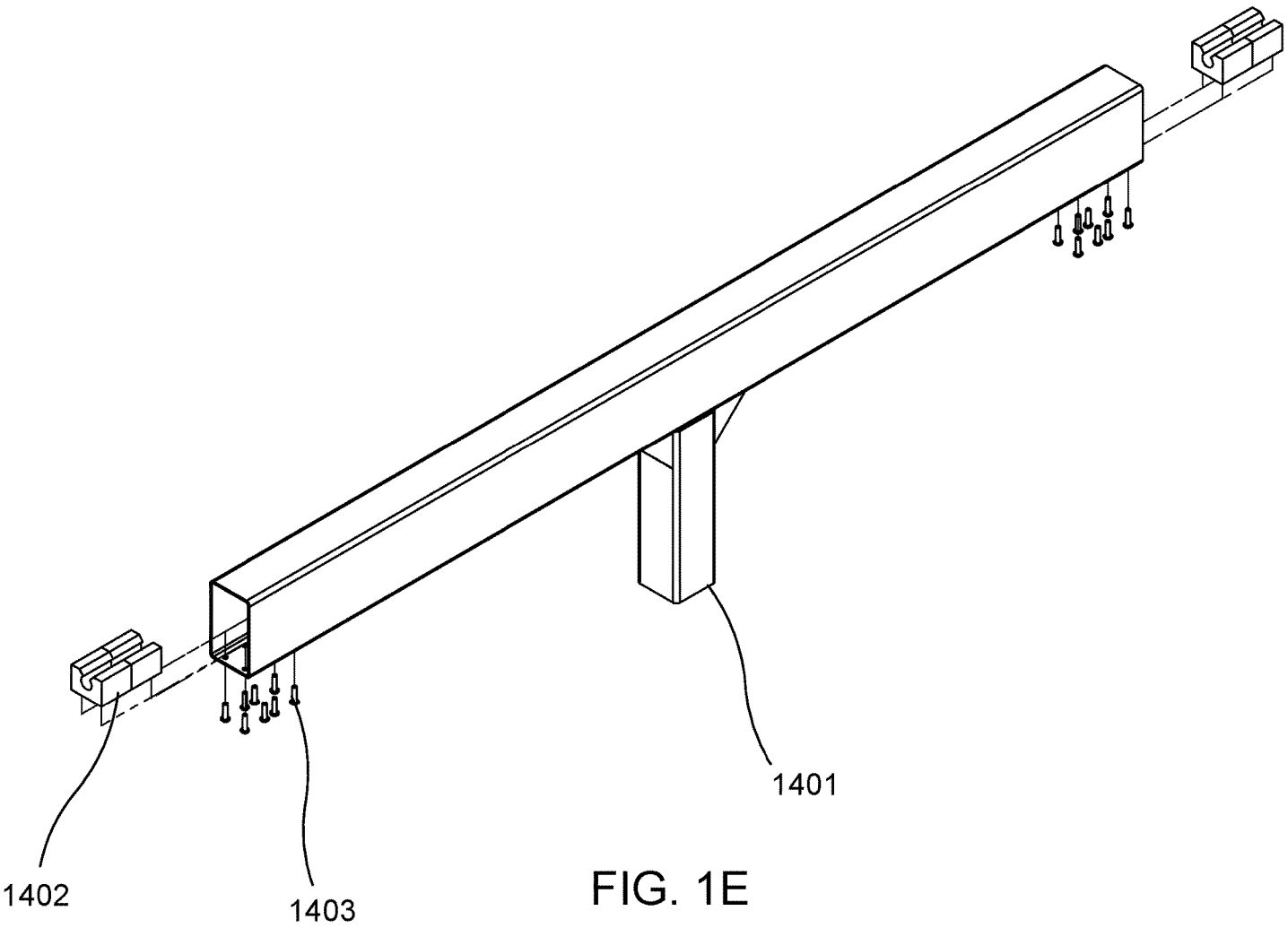
FIG. 1E illustrates an exploded view of a center bar of the adjustable modular frame system of FIG. 1A according to the disclosed embodiments.
Figure 1F:
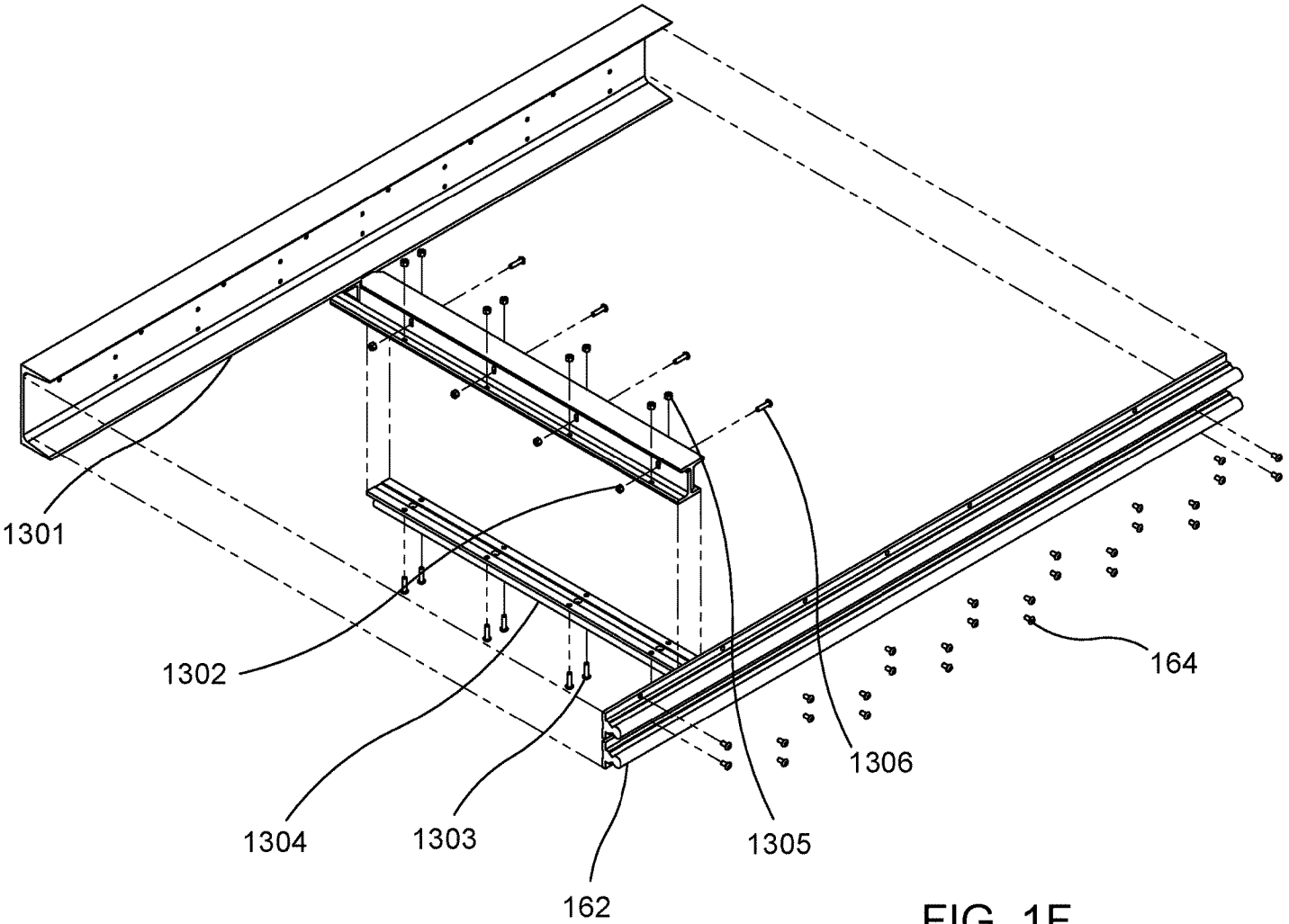
FIG. 1F illustrates an exploded view of a T-section support of the adjustable modular frame system of FIG. 1A according to the disclosed embodiments.
Figure 1G:
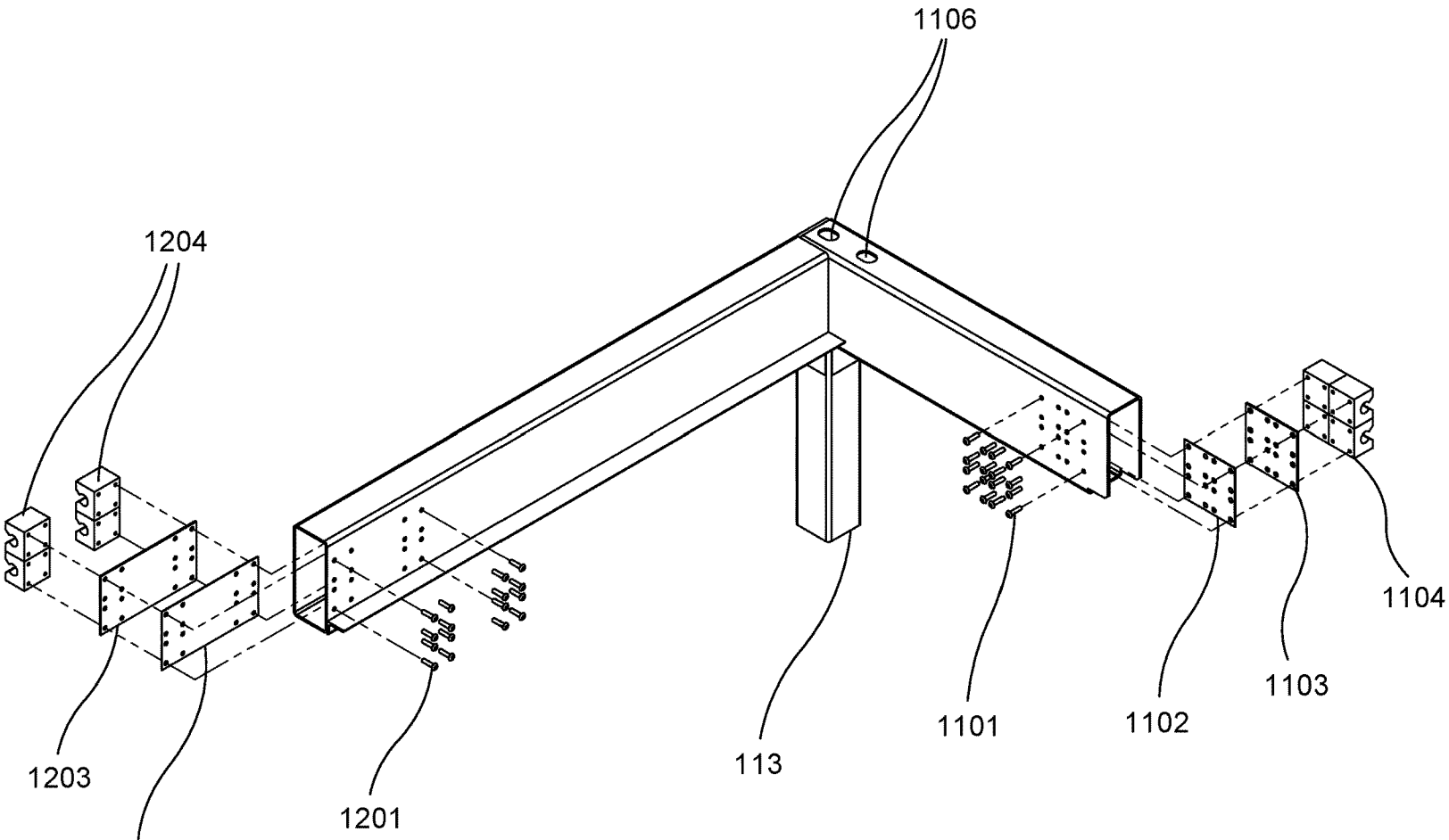
FIG. 1G illustrates an exploded view of a second corner support of the adjustable modular frame system of FIG. 1A according to the disclosed embodiments.
Figure 1H:
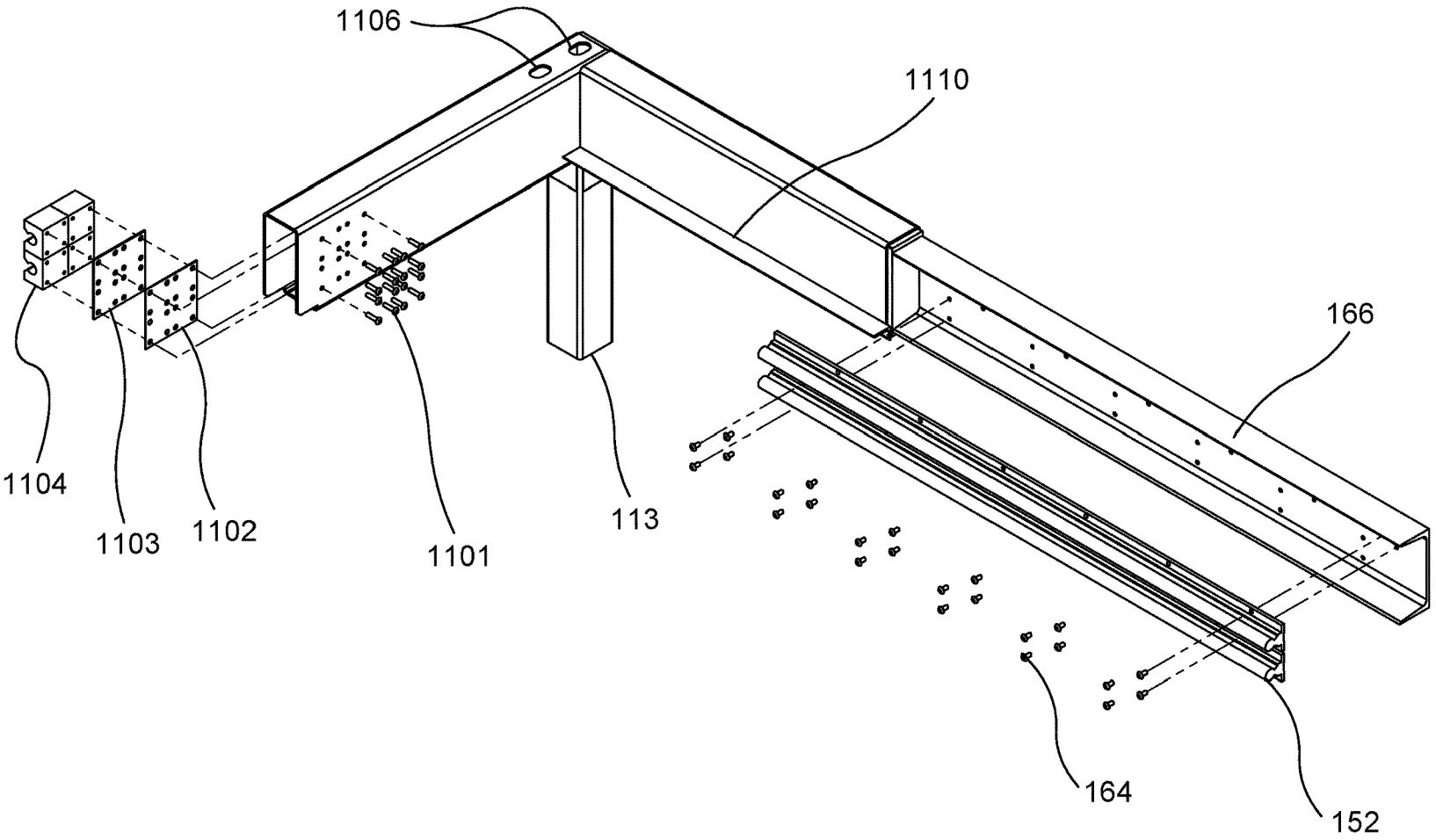
FIG. 1H illustrates an exploded view of a first corner support of the adjustable modular frame system of FIG. 1A according to the disclosed embodiments.
Figure 1I:
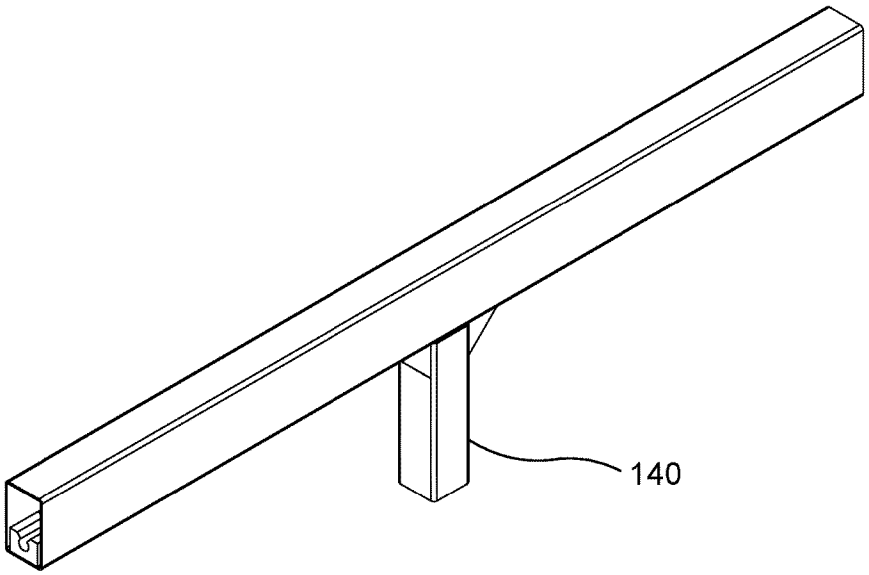
FIG. 1I illustrates a perspective view of the center bar according to the disclosed embodiments.
Figure 1J:
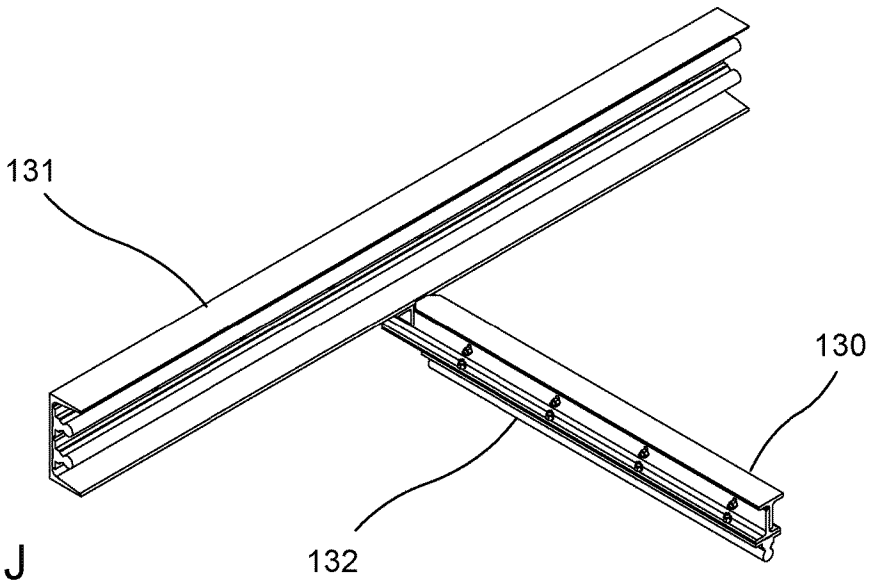
FIG. 1J illustrates a perspective view of the T-section support according to the disclosed embodiments.
Figure 1K:
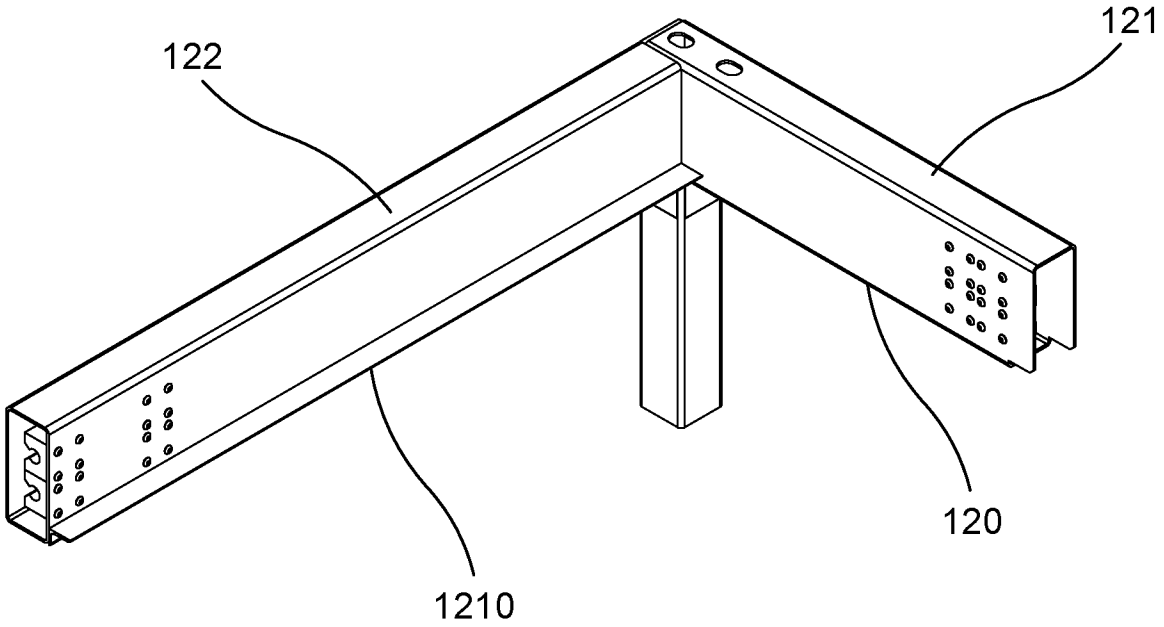
FIG. 1K illustrates a perspective view of the second corner support according to the disclosed embodiments.
Figure 1L:
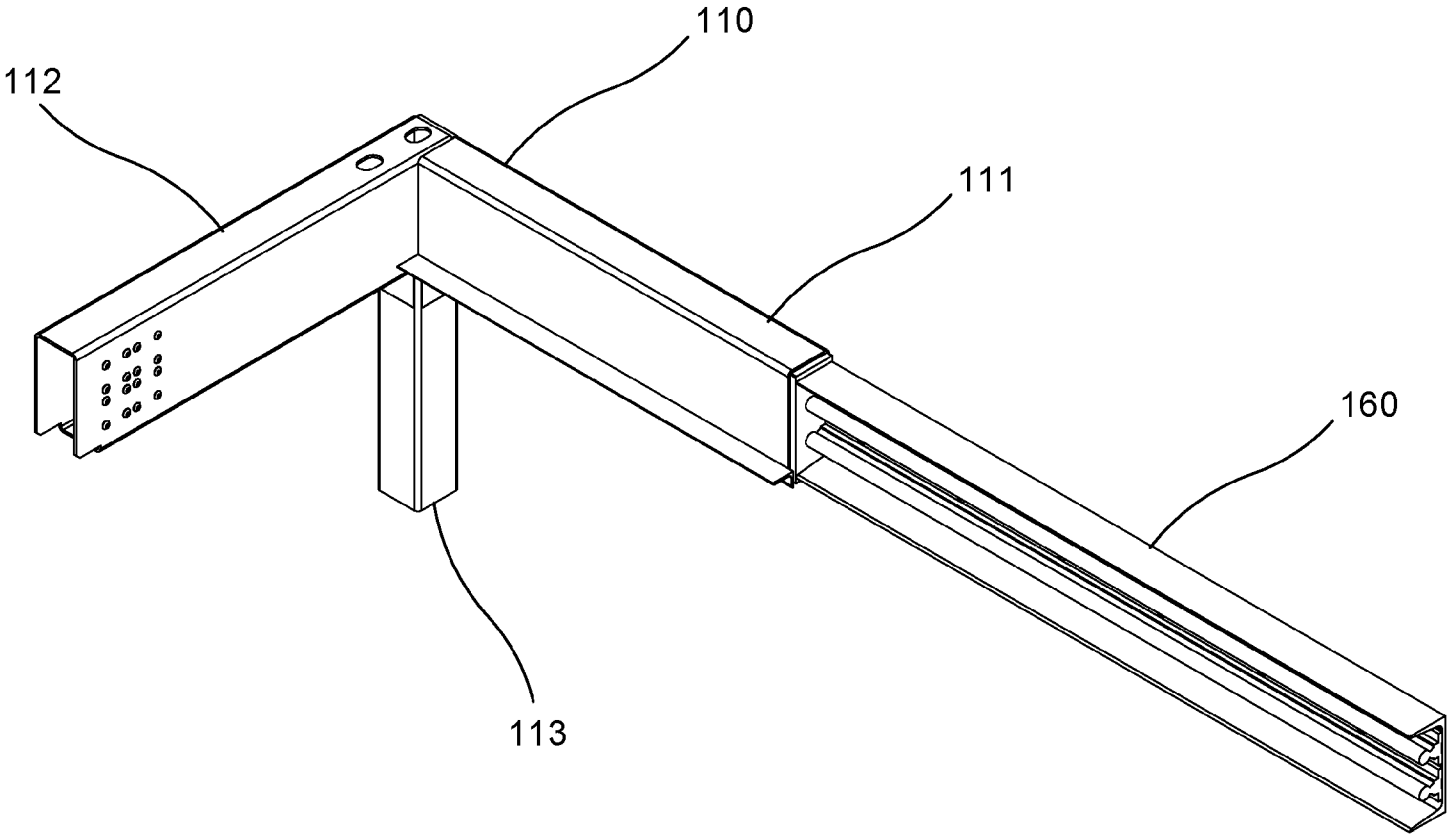
FIG. 1L illustrates a perspective view of the first corner support according to the disclosed embodiments.

FIGS. 1A-L depict an adjustable modular frame system 100 according to some embodiments. These figures show the different components of system 100. FIGS. 1A, 1C, and 1D depicts views of system 100 assembled without being adjusted beyond its smallest configuration. FIG. 1B depicts an exploded view of a disassembled system 100. FIGS. 1E, 1F, 1G, and 1H depict exploded views of the various components disclosed below. FIGS. 1I, 1J, 1K, and 1L depict perspective views of these components.

System 100 is adjustable in the lengthwise and widthwise directions. System 100 includes at least six distinct pieces that comprise the four sided member with one edge connected to a pair of adjacent but parallel edges. Each edge has an opposite edge with one set of parallel edges having an extended lip on the interior to allow support for a flat surface, such as a mattress, box spring, or cushion. Flat objects may rest on system 100 without the probability of slippage. A center bar extends in the same direction of the pair of edges with the lip and at the same planar level of the aforementioned edges. Preferably, system 100 is about 448.56 mm high, 1561 mm long, and 1119.53 mm wide, before it is expanded or adjusted. System 100 may be adjusted to fit any size, length, and width.

System 100 includes a pair of first corner supports 110, a pair of second corner supports 120, a pair of T-section supports 130, a center bar 140, and U-channel inserts 160 for support pieces 150. These components may be adjusted as needed to vary the dimensions of system 100. Each component is disclosed in greater detail below.

First corner supports 110 are located in opposite corners of system 100. Second corner supports 120 are located in the other corners. Thus, each side of system 100 includes one first corner support 110 and one second corner support 120. First corner support 110 includes a pair of rectangular tubes 111 and 112 extending perpendicularly so as to form a 90 degree angle. As shown, first rectangular tube 111 is slightly longer than second rectangular tube 112. The rectangular tubes also may be known as "arms." The rectangular tubes are connected to leg 113, which may be a tubular square that rests on the floor, ground, or surface.

First rectangular tube 111 connects to rectangular U-channel insert 160 having a rectangular end cup. First rectangular tube 111 also includes lip 1110, which extends inwardly to a center area enclosed by system 100. Rectangular U-channel insert 160 is enclosed by support piece 150, which includes lip 152. Lips 1110 and 152 are used to support the flat surface of the cushion, mattress, and the like for furniture. Second rectangular tube 112 extends perpendicularly from first rectangular tube 111. Second rectangular tube 112 attaches to T-section support 130. Second rectangular tube 112 includes a set of holes to receive screws 1101 that secure adapter parts 1102, 1103, and 1104 that receives the tracks of T-section support 130. Second rectangular tube 112 also includes holes 1106 that allow for other objects to slide into system 100 for a firm support. Preferably, the number of holes from screws 1101 is sixteen while the number of holes 1106 is 2.

As shown with first corner support 110, U-channel insert 160 includes track 162 that attaches to outer portion 166 with screws 164. Tracks 162 allows U-channel insert 160 to mate with second corner support 120, as disclosed below. First rectangular tube 111, however, receives U-channel insert 160 without engaging track 162.

Components of first corner support 110 may have the following dimensions. Preferably, first rectangular tube 111 is about 140 mm by 60 mm by 3 mm. The square lip on first rectangular tube 111 may be about 30 mm by 30 mm by 30 mm.

Second corner support 120 also includes a first rectangular tube 121 and a second rectangular tube 122. First rectangular tube 121 and second rectangular tube 122 are connected at a perpendicular angle at leg 113. Tubes 121 and 122 differ from tubes 111 and 112 of first corner support 110. For example, second rectangular tube 122 may be longer than first rectangular tube 111, while second rectangular tube 112 is about at the same size as first rectangular tube 121.

Second rectangular tube 122 includes square lip 1210 extending inwardly to a center area enclosed by system 100. First rectangular tube 121 includes a rectangular end cup attached on the outer most edge away from leg 113. Both tubes 121 and 122 include sets of sixteen holes to receive screws 1101 and 1201, respectively. First rectangular tube 121 uses the holes and screws 1101 to secure adapter parts 1102, 1103, and 1104 that receives the tracks of T-section support 130. Thus, first rectangular tube 121 may face or touch second rectangular tube 112 of first corner support 110. Second rectangular tube 122 uses the holes and screws 1201 to secure adapter parts 1202, 1203, and 1204. Adapter parts 1202, 1203, and 1204 differ from adapter parts 1102, 1103, and 1104 as they are longer. Adapter parts 1202, 1203, and 1204 receive tracks 162 of U-channel insert 160. First rectangular tube 121 also includes holes 1106 located above leg 113.

Corner supports 110 and 120 may be connected directly together using the track assemblies of U-channel insert 160 and T-section support 130. The respective rectangular tube may engage the tracks. T-section supports 130 may be placed between second rectangular tube 112 and first rectangular tube 121. These are the tubes without lips. T-section supports 130 also connect with center bar 140 to provide support within system 100.

T-section support 130 includes upper part 131 and lower part 132. Upper part 131 may engage rectangular tubes 112 and 121, while lower part 132 engages center bar 140. Lower part 132 is located below upper part 131 and extends perpendicularly inwards to frame 100. Preferably, upper part 131 is longer then lower part 132.

Upper part 131 houses the track section of T-section support 130. Thus, track 162 is secured by screws 164 to outer portion 1301. Preferably, twenty eight holes and screws are placed intermittently in pairs across the length of track 162. Track 162 couples or engages with the adaptors used in first corner support 110 and second corner support 120. Lower part 132 includes support bar 1302, or T-section, that attaches to channel track 1304 using screws 1302, 1303, and 1305.

Center bar 140 is placed between two T-section supports 130 and engages lower parts 132. In other words, lower parts 132 hold center bar 140. Center bar 140 may be a horizontal tube that placed perpendicularly to T-section support 130. It acts as a base for system 100. Center bar 140 includes leg 1401 held in place by a pair of triangular gussets. Center bar 140 also includes two sets of adapters 1402 and 1403 placed at the open ends. Adapter 1402 includes a channel to engage channel track 1304. Thus, center bar 140 is secured between T-section supports 130.

System 100 also includes support piece 150, as disclosed above. Support piece 150 may enclose U-channel insert 160, which includes track 162. Support piece 150 may engage first rectangular tube 111 of first corner support 110 and second rectangular tube 122 of second corner support 120. Support piece 150 includes lip 152. Lip 152 may be slightly larger than lips 1110 and 1210. Support piece 150 may act as a bridge protector between first corner support 110 and second corner support 120. System 100 may extend or contract without any damage to the underlying components. For example, various sizes of U-channel insert 160 may be used to adjust the size of system 100. Support piece 150 also may vary in size to accommodate the size of a U-channel insert 160. As shown in FIG. 1, support piece 150 may cover the rectangular tubes on the outside.

Head accessory 170 acts as a protective encasement, or back cover, for rectangular tubes 112 and 121. As such, head accessory 170 may cover upper part 131 of T-section support 130.

Using the disclosed configuration, system 100 may be adjusted in size and shape. First corner supports 110 may provide a fixed part to hold U-channel inserts 160. As indicated above, the systems may act as a frame that expands length-wise and width-wise. The process by which the frame can be expanded is a manual process. The individual attempting the expansion may pull length-wise and width-wise. The system expansion has indicators informing the user of the appropriate length markers for the possible mattress size i.e. twin, full, queen and king configurations. These markers provide the appropriate dimensions for the user.

FIGS. 2A-E disclose another adjustable module frame system 200 according to the disclosed embodiments. System 200 differs from system 100 in terms of components and configuration. Further, system 200 may be lighter in weight and easier to store than system 100. System 200, however, is adjustable to accommodate a variety of furniture pieces like system 100. One may adjust the pieces disclosed herein to configure system 200 to any size frame.

Figure 2A:
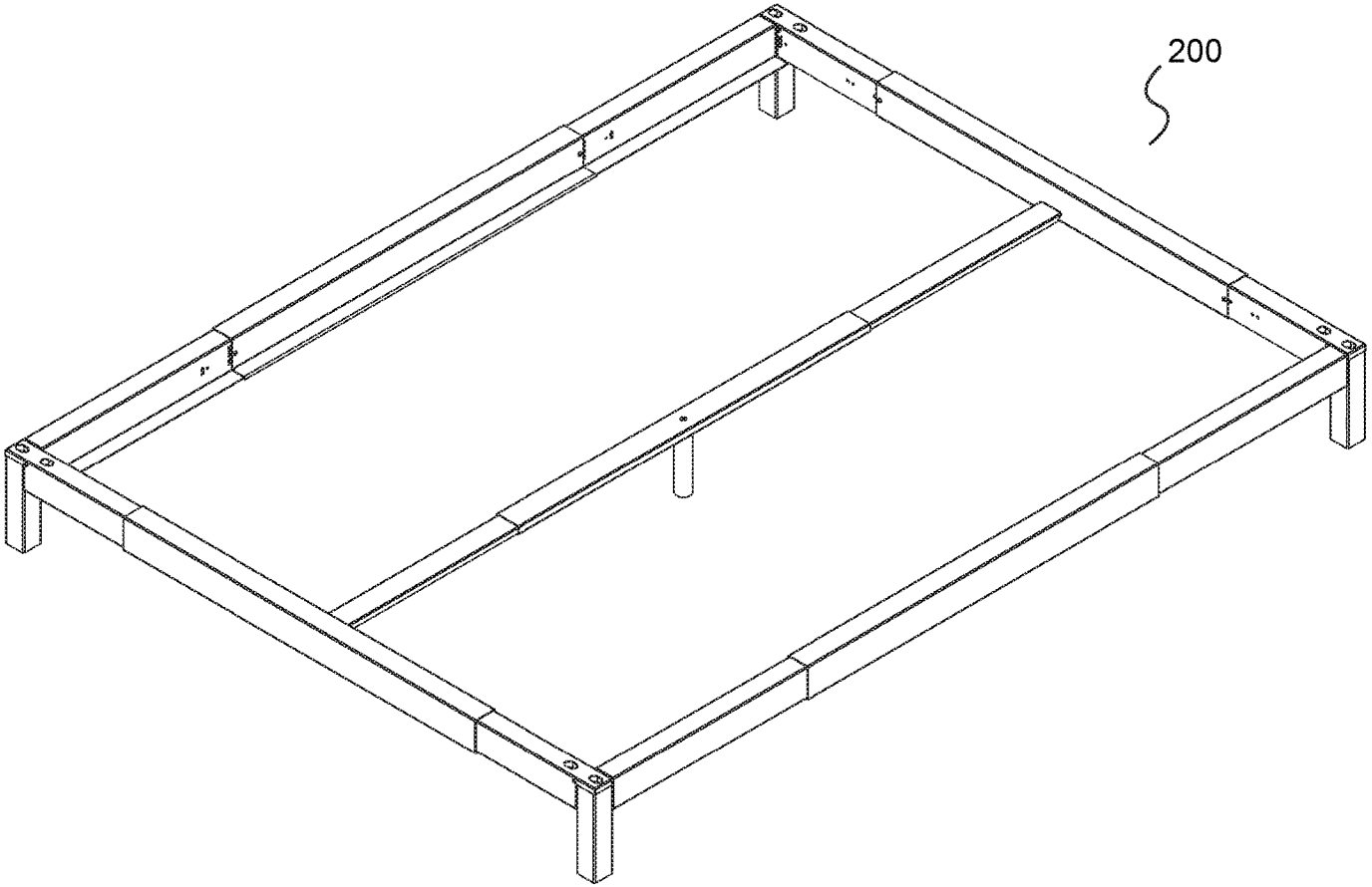
FIG. 2A illustrates a perspective view of another adjustable modular frame system according to the disclosed embodiments.
Figure 2B:
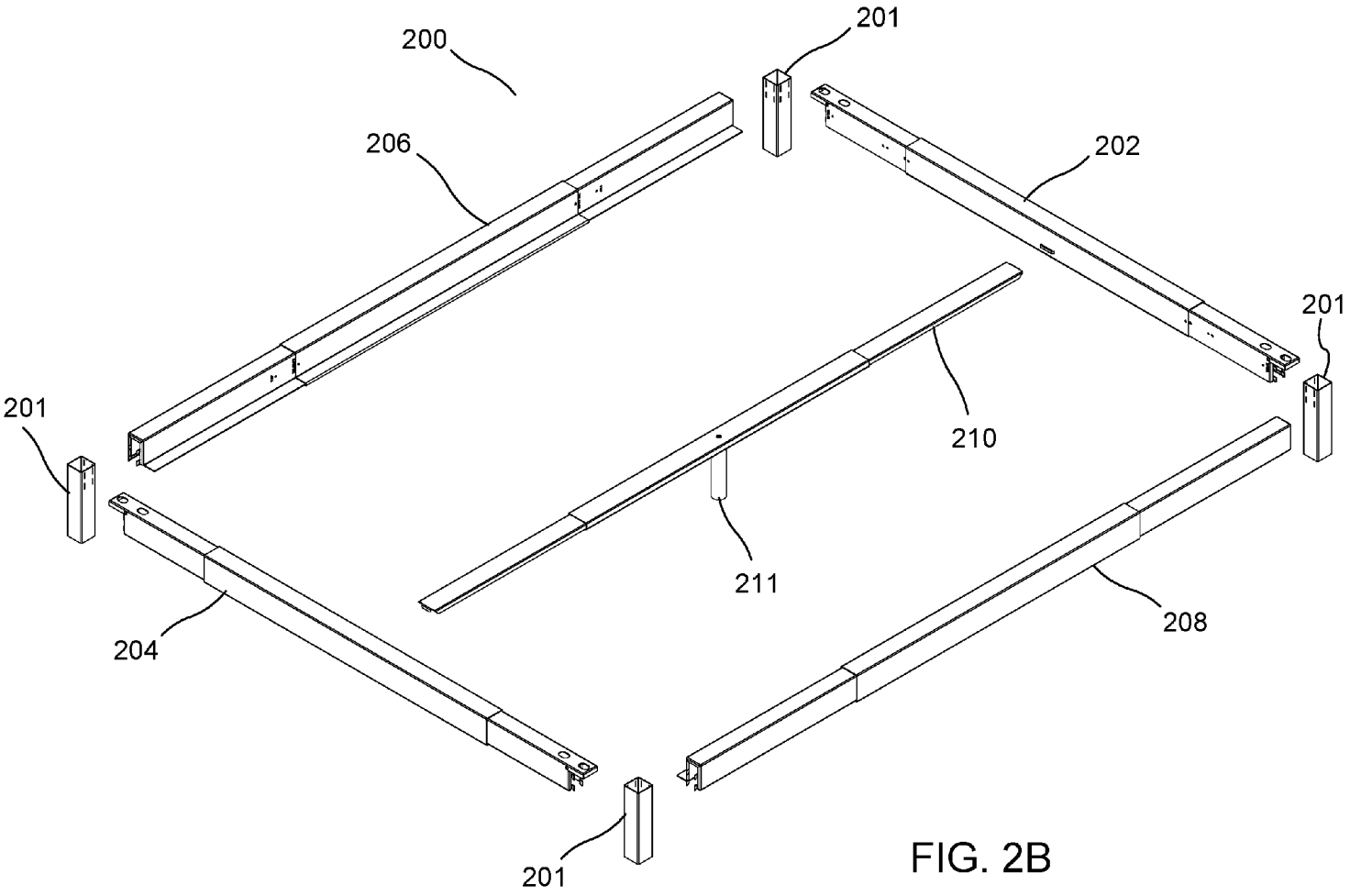
FIG. 2B illustrates an exploded view of the adjustable modular frame system of FIG. 2A according to the disclosed embodiments.

Referring to FIG. 2A, system 200 is shown assembled. Preferably, FIG. 2A depicts system 200 at its "smallest" configuration. None of the pieces have been adjusted to accommodate larger pieces of furniture. FIG. 2B depicts an exploded view of system 200 and includes the different components assembled therein.

As shown, system 200 includes a plurality of legs 201 that support the rest of system 200 on a surface. System 200 also includes a pair of support rails 202 and 204 located opposite each other. Support rail 202 may be referred to as the top support rail and support rail 204 may be referred to as the bottom support rail. Alternatively, support rails 202 and 204 may be referred to as the width-wise rails. System 200 also includes a pair of side rails 206 and 208. Side rail 206 may be referred to as the left side rail and side rail 208 may be referred to as the right side rail. Side rails 206 and 208 include lips that support the piece of furniture within system 200. System 200 also includes center rail 210 that connects to top support rail 202 and bottom support rail 204 to provide a center support piece for the piece of furniture. Preferably, center rail 210 includes a leg piece 211. All of these components of system 200 are disclosed in greater detail below.

Figure 2C:
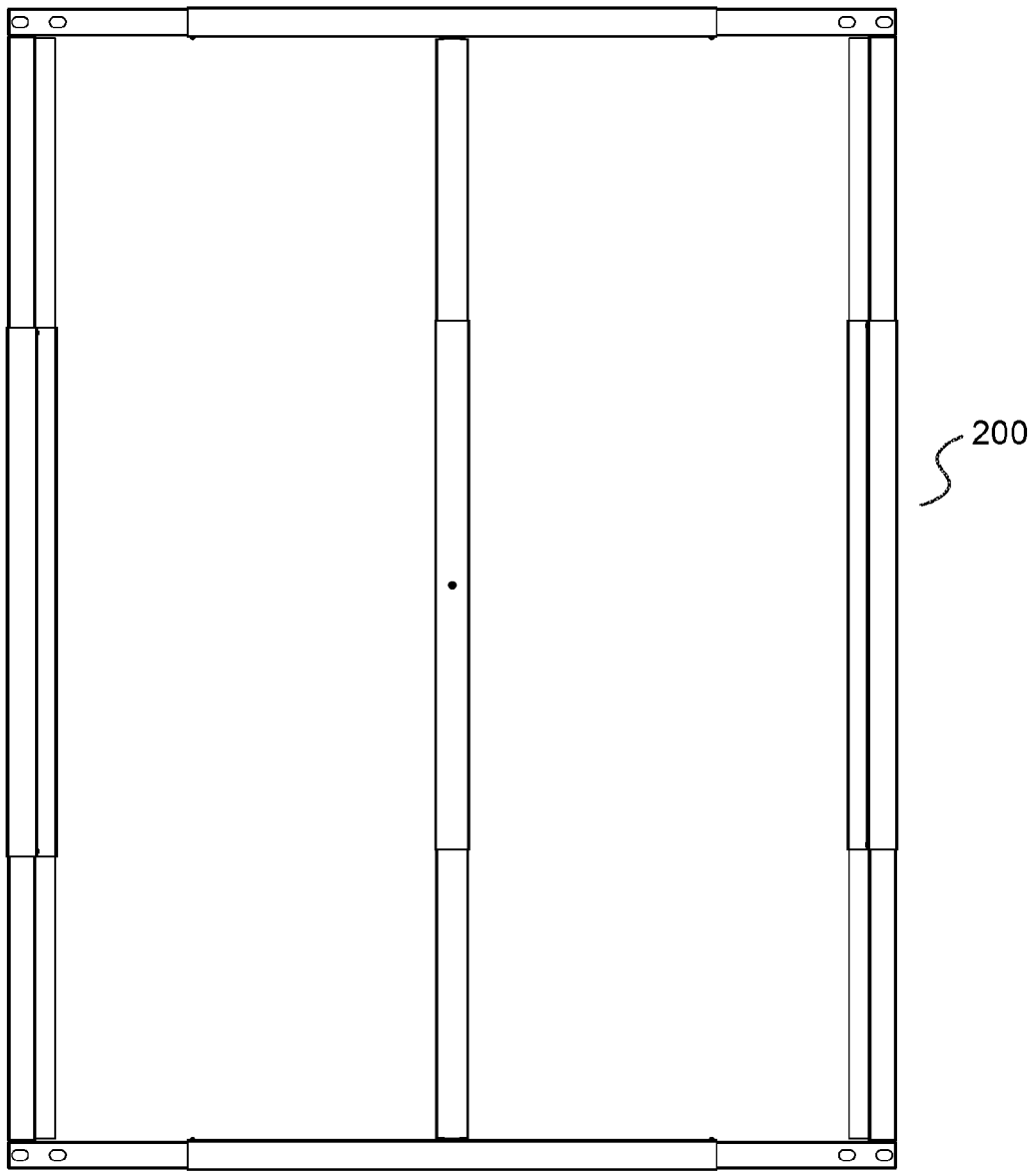
FIG. 2C illustrates a top view of the adjustable modular frame system of FIG. 2A according to the disclosed embodiments.
Figure 2D:
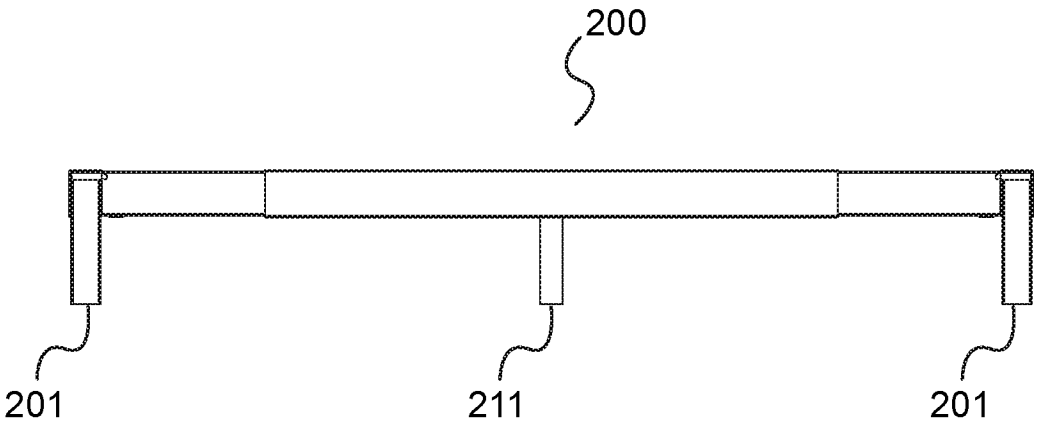
FIG. 2D illustrates a top or bottom view of the adjustable modular frame system of FIG. 2A according to the disclosed embodiments.
Figure 2E:
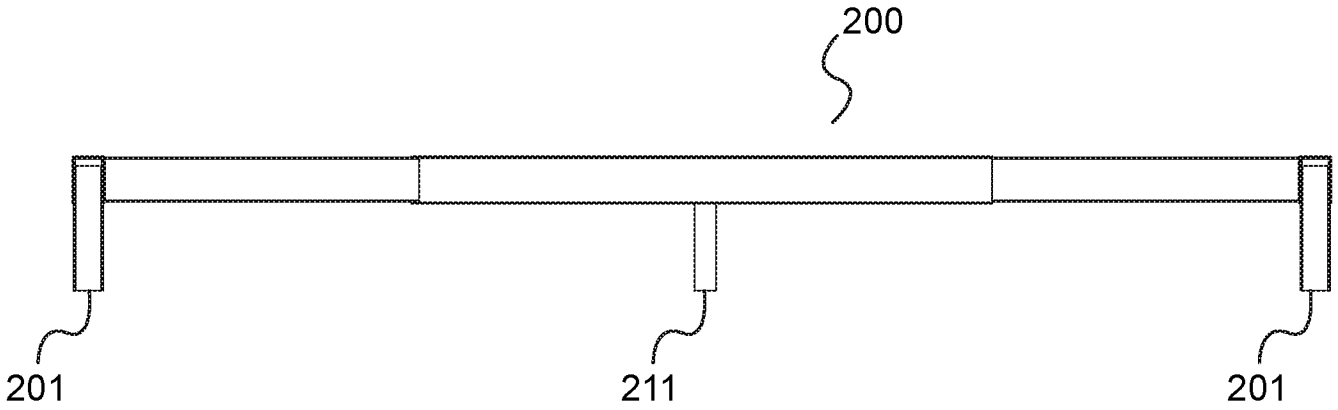
FIG. 2E illustrates a side view of the adjustable modular frame system of FIG. 2A according to the disclosed embodiments.

FIG. 2C depicts a top view of system 200. Center rail 210 is located about midway between side rails 206 and 208 and connected to support rails 202 and 204. The lips of side rails 206 and 208 also may be seen. FIG. 2D depicts a top or bottom view of system 200. FIG. 2D also may be known as a width-wise view of system 200. As can be seen, legs 201 differ from leg piece 211. Leg piece 211 may be shorter in length than legs 201. FIG. 2E depicts a side view of system 200. FIG. 2E also may be known as a length-wise view of system 200. The relationship between legs 201 and leg piece 211 may be shown in greater detail.

Figure 3C:
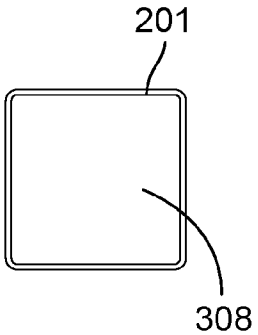
FIG. 3C illustrates a top view of the leg of FIG. 3A according to the disclosed embodiments.
Figure 3B:
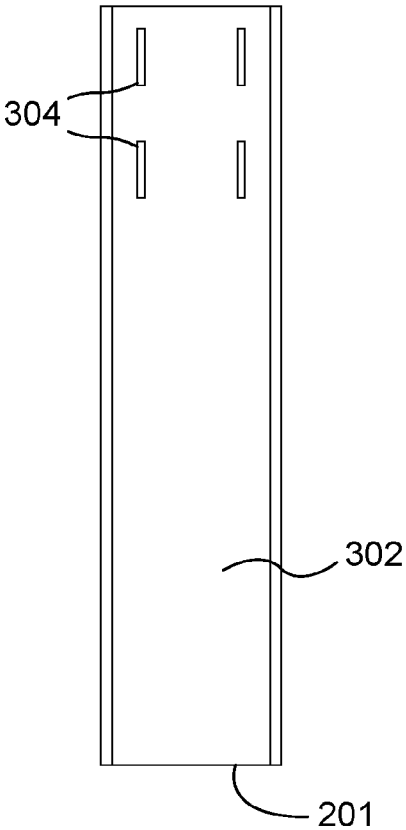
FIG. 3B illustrates a side view of the leg of FIG. 3A according to the disclosed embodiments.
Figure 3A:
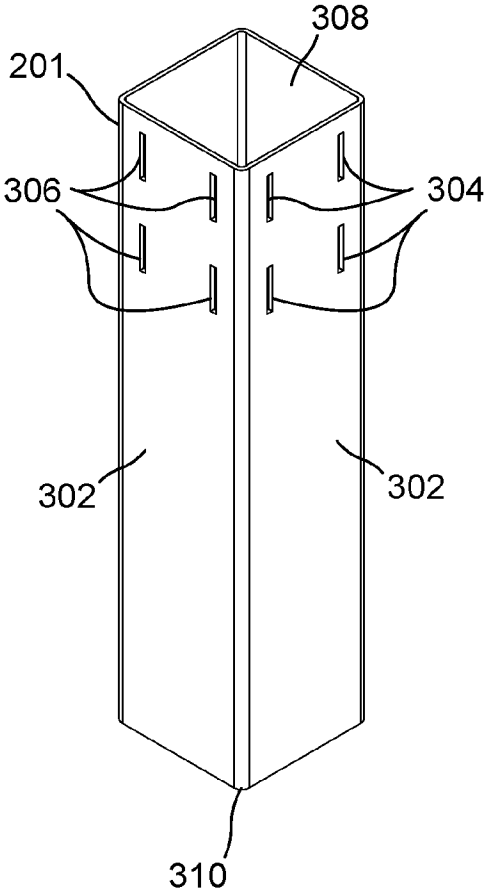
FIG. 3A illustrates a perspective view of a leg for the adjustable modular frame system according to the disclosed embodiments.

The separate components and pieces of system 200 are disclosed in greater detail. FIGS. 3A-C depict a leg 201 of the plurality of legs according to the disclosed embodiments. Legs 201 may be located in the corners of system 200. As shown, system 200 includes four legs 201 that connect with support rail 202 or 204 and side rail 206 or 208. In some embodiments, additional legs 201 may be used, as needed. Leg 201 may have a substantially square cross-sectional shape with rectangular-shaped sides 302. Sides 302 may have a length between 8 centimeters (cm) and 9 cm and a width between 1.5 cm to 2.5 cm. More preferably, sides 302 may a length of about 8.425 cm and a width of about 2 cm.

Leg 201 also includes slots 304 and 306. In some embodiments, slots 304 face towards support rail 202 or 204 and slots 306 face towards side rail 206 or 208. Alternatively, slots 304 and 306 may be on sides 302 opposite each other such that each side includes slots. Slots 304 and 306 are sets of four slots, though any number of slots may be used. The slots received protrusions from the rails, disclosed in greater detail below. Slots 304 and 306 may have dimensions of a width of about 0.085 cm and a length of about 0.625 cm. Slots 304 and 306 may include two top slots with tops of about 0.25 cm from an end of side 302. Two bottom slots may be about 1.5 cm from the end of side 302, as shown in FIG. 3B. The slots also may be two slots on each side that are spaced apart from each other by about 1.112 cm and located about 0.444 cm from the edges of side 302. Referring to FIG. 2C, leg 201 may include a hollow center 308 to configure the leg as square tubing. Leg 201 also includes edges 310, which are rounded. This prevents the use of sharp edges when assembling system 200.

FIGS. 4A-J depicts a support rail 202 for system 200 according to the disclosed embodiments. Although top support rail 202 is shown, FIGS. 4A-H also may apply to bottom support rail 204. Support rail 202 may attach to two legs 201 using flatbars 411 and mounting projections 420. Mounting projections 420 fit into slots 304 and 306 of legs 201.

Figure 4A:
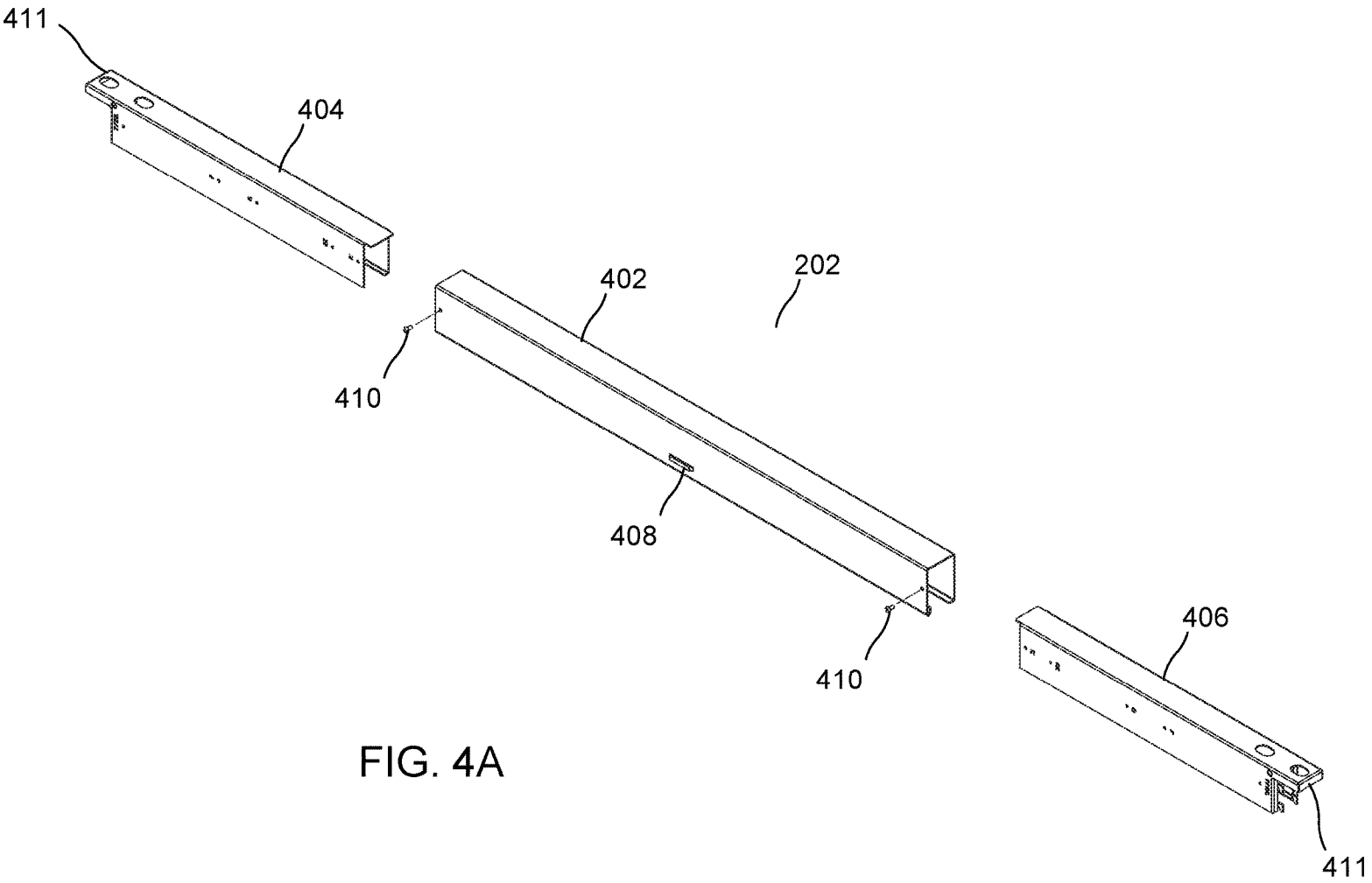
FIG. 4A illustrates an exploded view of a support rail for the adjustable modular frame system of FIG. 2B according to the disclosed embodiments.

FIG. 4A depicts an exploded view of support rail 202. Support rail includes a middle support piece 402 and a pair of adjustable support pieces 404 and 406. Adjustable support piece 404 may be the left side adjustable support piece. Adjustable support piece 406 may be the right side adjustable support piece. Middle support piece 402 shown in FIG. 4D also includes a slot 408 located approximately in the middle of the middle support piece. Slot 408 receives a tab from center rail 210. Slot 408 may be flat with a length of about 1.42 cm.

Figure 4B:
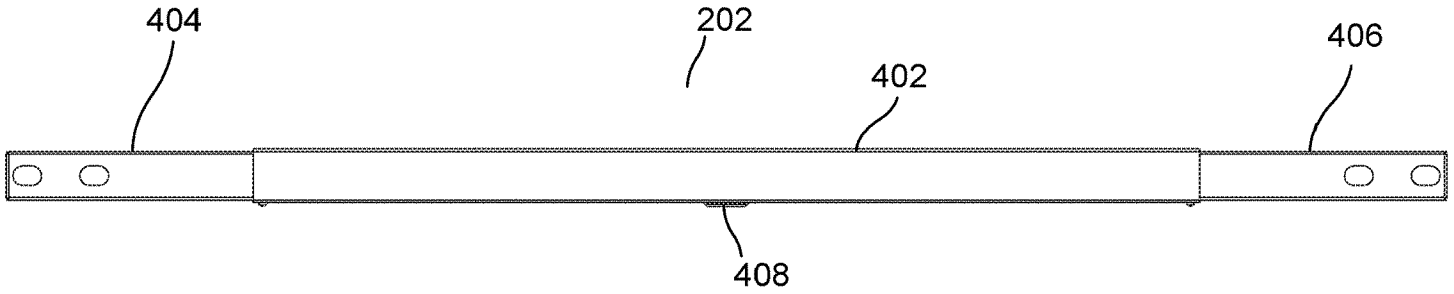
FIG. 4B illustrates a top view of the support rail according to the disclosed embodiments.
Figure 4C:
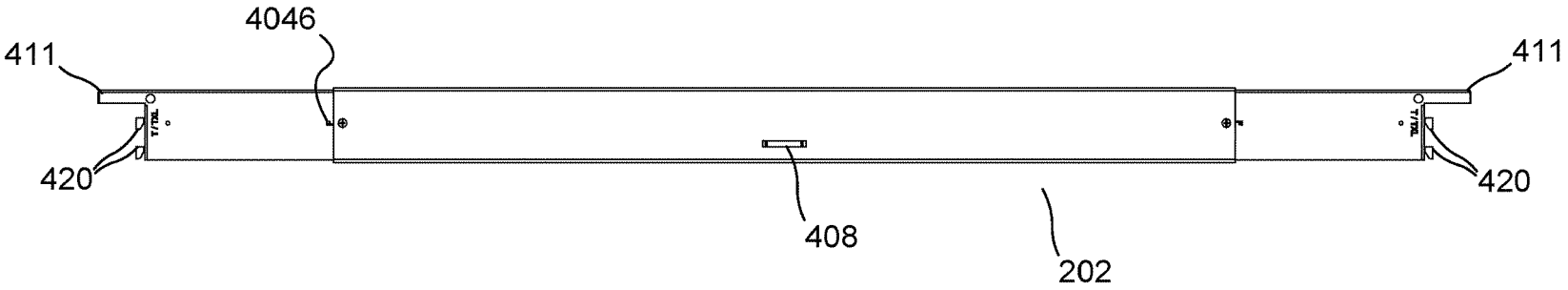
FIG. 4C illustrates a side view of the support rail according to the disclosed embodiments.

As can be seen in FIG. 4A, adjustable support pieces 404 and 406 fit inside middle support piece 402 such that they are movable to adjust the length of support rail 202. Screws 410 may insert through a hole 4025 on each side of middle support piece 402 and into a corresponding hole 4048 on adjustable support pieces 404 and 406. The holes in the adjustable support pieces may correspond to a desired size for system 200. Referring to FIG. 4H, markings 4046 indicate the size for corresponding holes 4048. Using a bed example, the markings may indicate the hole to insert screw 410 to achieve the desired size for the bed. Thus, markings 4046 may indicate twin, full, queen, California king, and king sizes. One moves adjustable support piece 404 or 406 within middle support piece 402 to align with the proper marking and inserts screw 410 into the holes. A nut may engage screw 410 to provide further stability for system 200.

Figure 4E:
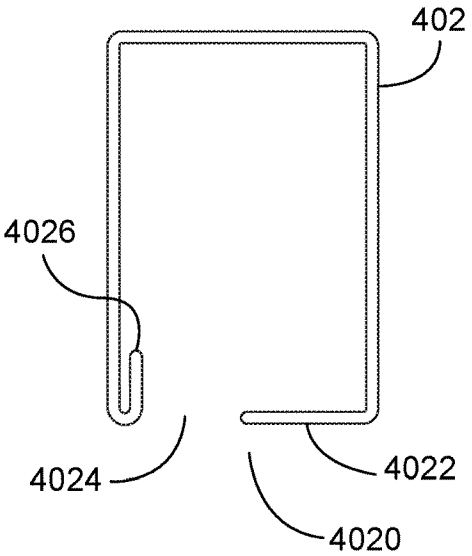
FIG. 4E illustrates a side view of the middle support piece according to the disclosed embodiments.
Figure 4D:
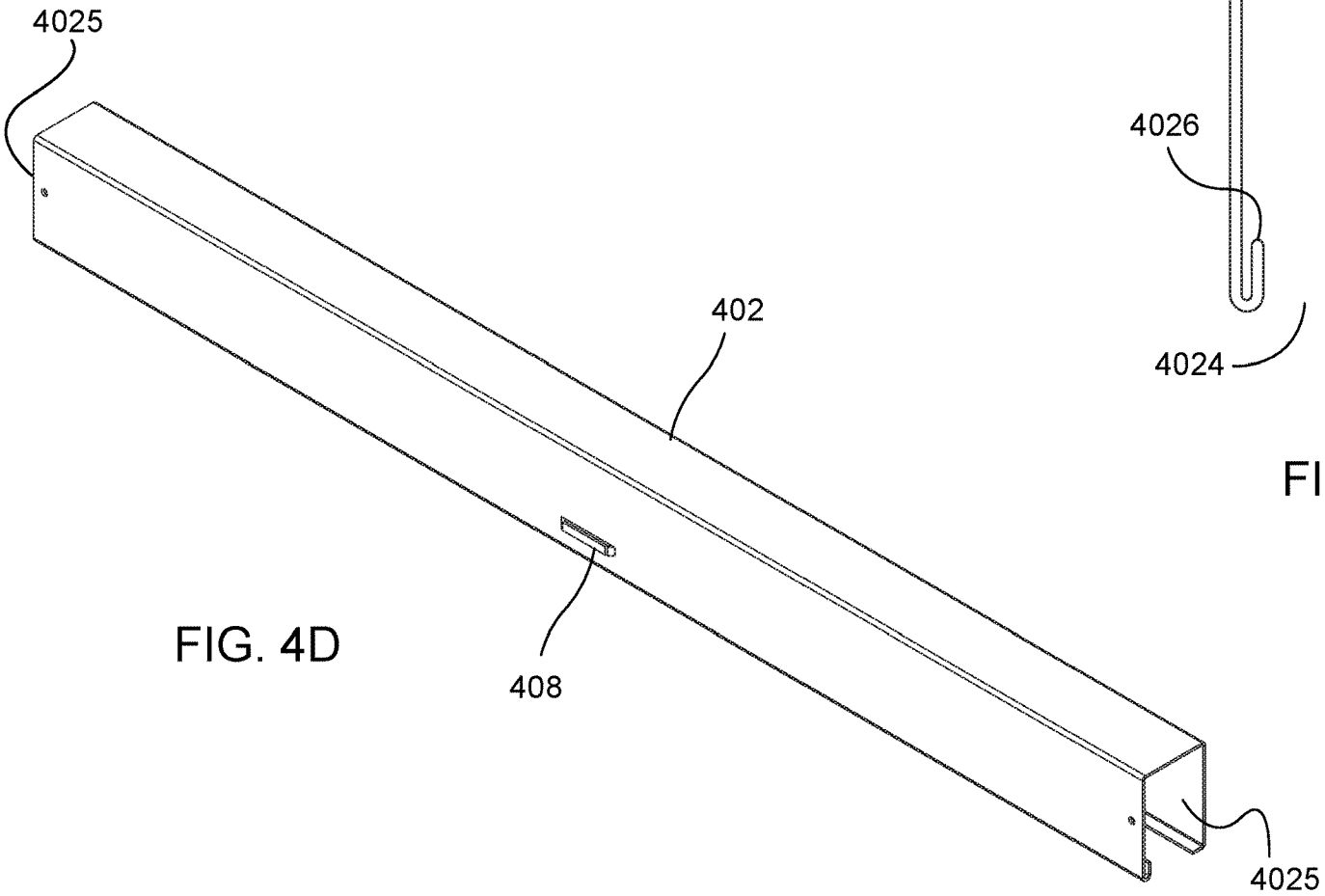
FIG. 4D illustrates a perspective view of a middle support piece of the support rail of FIG. 4A according to the disclosed embodiments.
Figure 4F:
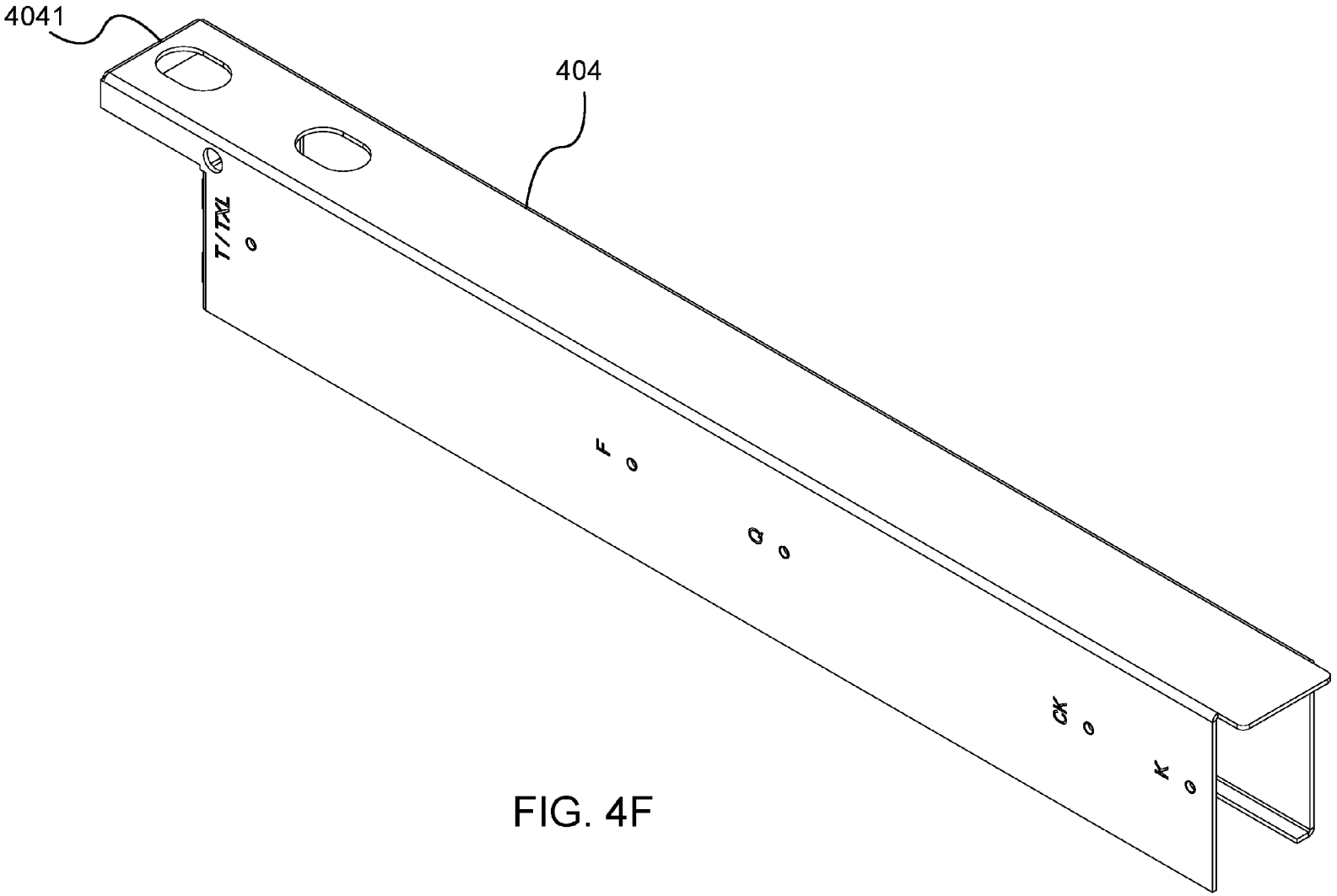
FIG. 4F illustrates a perspective view of an adjustable support piece of the support rail of FIG. 4A according to the disclosed embodiments.

FIG. 4E depicts a side view of middle support piece 402. Middle support piece 402 is hollow with a bottom side 4020. Bottom side 4020 includes a channel 4024. Channel 4024 is bounded by a flat support portion 4022 and a bent portion 4026. Flat support portion 4022 may extend about halfway across bottom side 4020. Bent portion 4026 extends inwardly into the hollow midsection of middle support piece 402. Bent portion 4026 provides a groove to engage a side 4045 of each adjustable support piece. Side 4045 slides into bent portion 4026 to adjust system 200. Bent portion 4026 also supports adjustable support pieces 404 and 406.

Figure 4G:
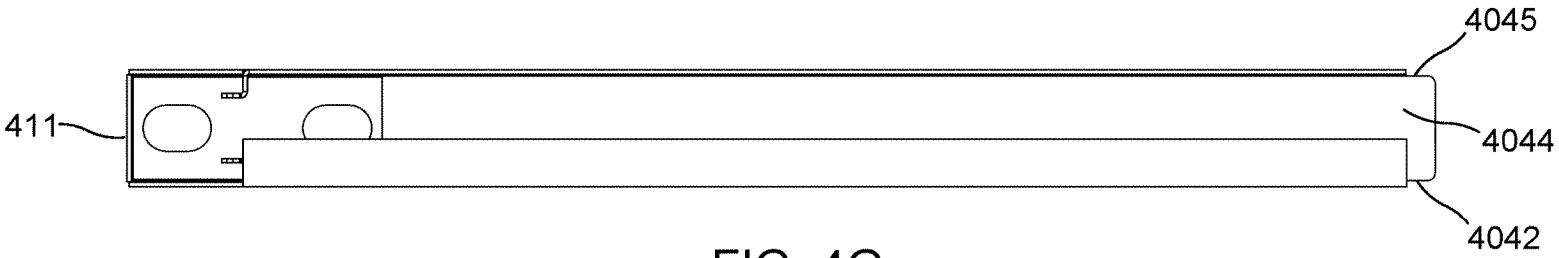
FIG. 4G illustrates a bottom view of the adjustable support piece according to the disclosed embodiments.
Figure 4H:
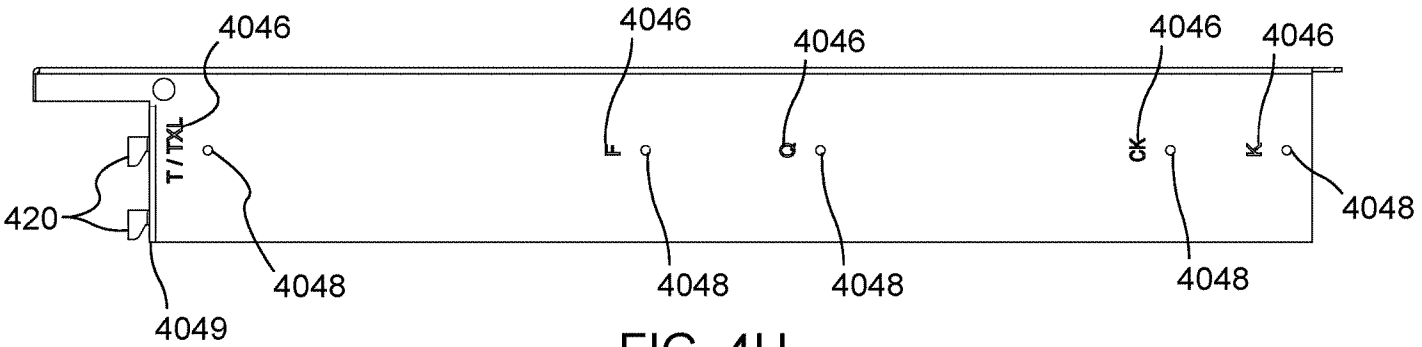
FIG. 4H illustrates a side view of the adjustable support piece according to the disclosed embodiments.

Flat support portion 4022 also provides support for adjustable support pieces while inside middle support piece 402. Flat section 4042 of each adjustable support piece 404 and 406 may rest on flat support portion 4022. Flat section 4042 is shown in FIG. 4G. Adjustable support piece 404 or 406 also includes a channel 4044 so that channels 4024 and 4044 overlap each other.

Figure 4I:
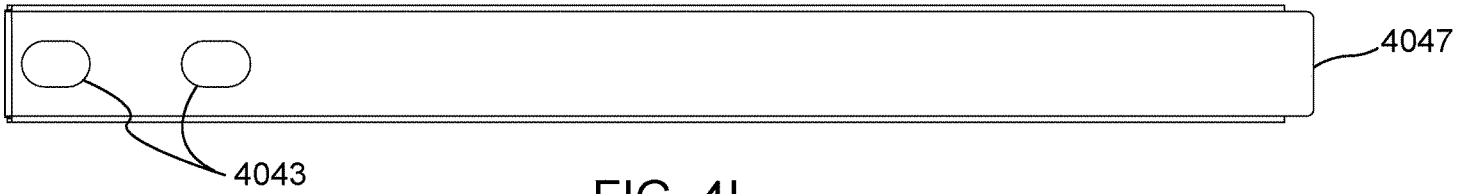
FIG. 4I illustrates a top view of the adjustable support piece according to the disclosed embodiments.
Figure 4J:
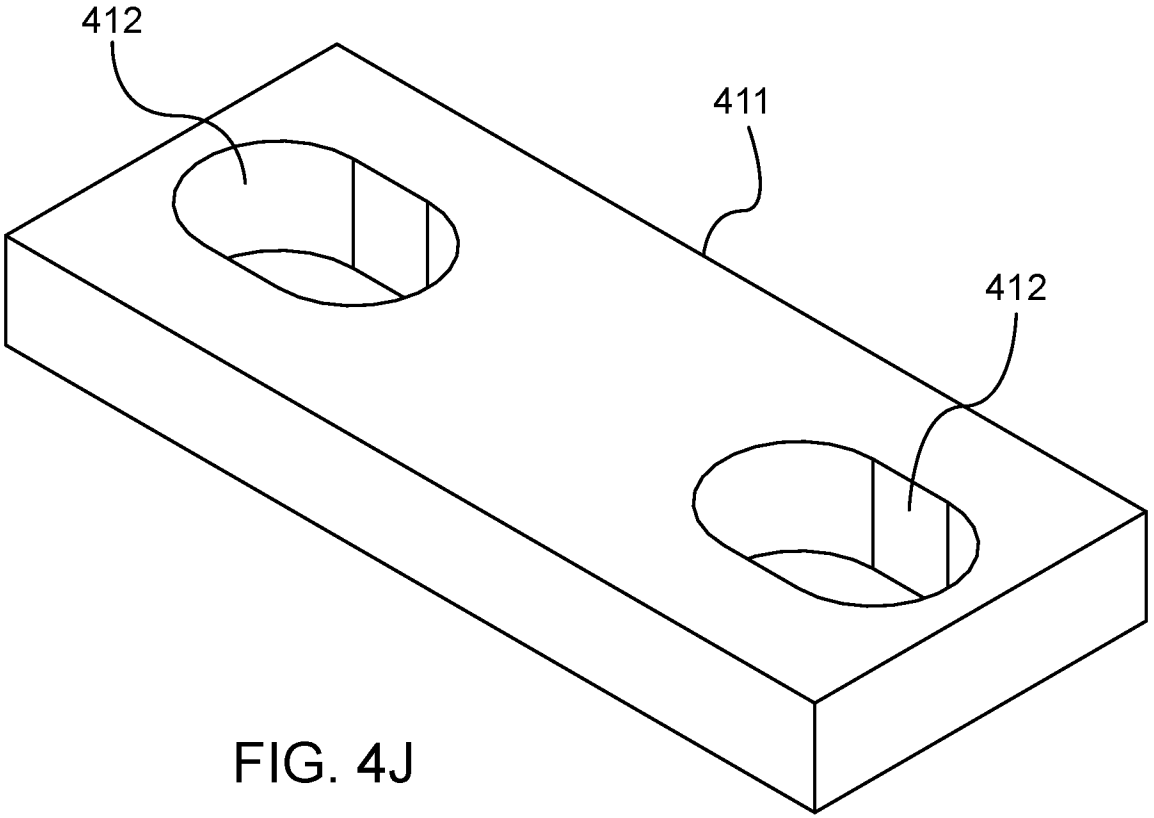
FIG. 4J illustrates a flatbar of the support rail of FIG. 4A according to the disclosed embodiments.

Adjustable support pieces 404 and 406 also include flatbars 411. Flatbar 411 is shown in FIG. 4J. Flatbar 411 includes holes 412. Hole 412 may have an oval shape and engage with leg 201. In other words, a hole 412 may overlap hollow center 308. Holes 412 also may allow pieces of furniture to be mounted on system 200. For example, a headboard may be fit into corresponding hole 412 for a bed. Flatbar 411 may be about 4 cm to 5 cm in length, and, more particularly, may be about 4.273 cm in length. Flatbar 411 may have a width of about 1.5 cm to 2 cm, and, more particularly, may be about 1.75 cm. Centers of holes 412 in each flatbar 411 may be about 2.5 cm to 3 cm apart. More particularly, the centers may be about 2.746 cm apart. As shown in FIGS. 4G and 4I, flatbar 411 may fit into an extension portion 4041 of each adjustable support piece. Adjustable support pieces 404 and 406 include holes 4043 to align with holes 412.

Preferred dimensions for middle support piece 402 and adjustable support pieces 404 and 406 may be provided. Middle support piece 402 may be about 35 cm to 40 cm in length, and, more particularly, about 38.74 cm in length. The distance between holes 4025 may be about 38 cm. The distance from an end of middle support piece 402 and a middle of slot 408 may be about 19.38 cm. The width of middle support piece 402 may be about 2 cm to 3 cm. More particularly, the width may be about 2.2 cm. The depth of middle support piece 402 may be about 3 cm to 3.5 cm. More particularly, the depth may be about 3.188 cm. A length of flat support portion 4022 may be about 1 cm. A length of bent portion 4026 may be about 0.50 cm.

Adjustable support pieces 404 and 406 may have a top side length of about 22 cm to 23 cm, and, more particularly, a top side length of 22.89 from an end 4047 of the adjustable support piece inserted into middle support piece and the end of extension portion 4041. The width of each adjustable support piece may be about 2 cm to fit within the width of middle support piece 402. The depth of each adjustable support piece may be about 3 cm to also fit within the depth of middle support piece 402. As shown in FIG. 4I, end 4047 narrows slightly from the width of adjustable support piece 404 or 406.

Mounting projections 420 project from end 4049 of each adjustable support piece. Mounting projections 420 fit into slots 304 and 306 of legs 201 to mount support rail 202 or 204. Preferably, there are four mounting projections 420 for each adjustable support piece 404 or 406. Mounting projections 420 may include a downwardly shaped portion that goes into the slots on legs 201 to mount to the legs. Mounting projections 420 should not dislodge from legs 201 absent some movement of the support rails to do so. FIGS. 4B and 4C depict support rail 202 in an extended configuration with adjustable support pieces 404 and 406 moved to the "full" bed configuration as shown by markings 4046. Adjustable support pieces 404 and 406 fit and move within middle support piece 402.

FIGS. 5A-G depict side rail 206 according to the disclosed embodiments. Side rail 208 also may include the configuration and concepts disclosed in FIGS. 5A-G. Side rails 206 and 208 attach to legs 201 using mounting projections 510. Mounting projections 510 insert into slots 304 and 306. Side rails 206 and 208 differ from support rails 202 and 204 in that they also include lips 508 and 509. Lips 508 and 509 provide support for a piece of furniture to rest upon. Side rails 206 and 208 also are adjustable to configure into a variety of sizes for system 200.

Figure 5A:
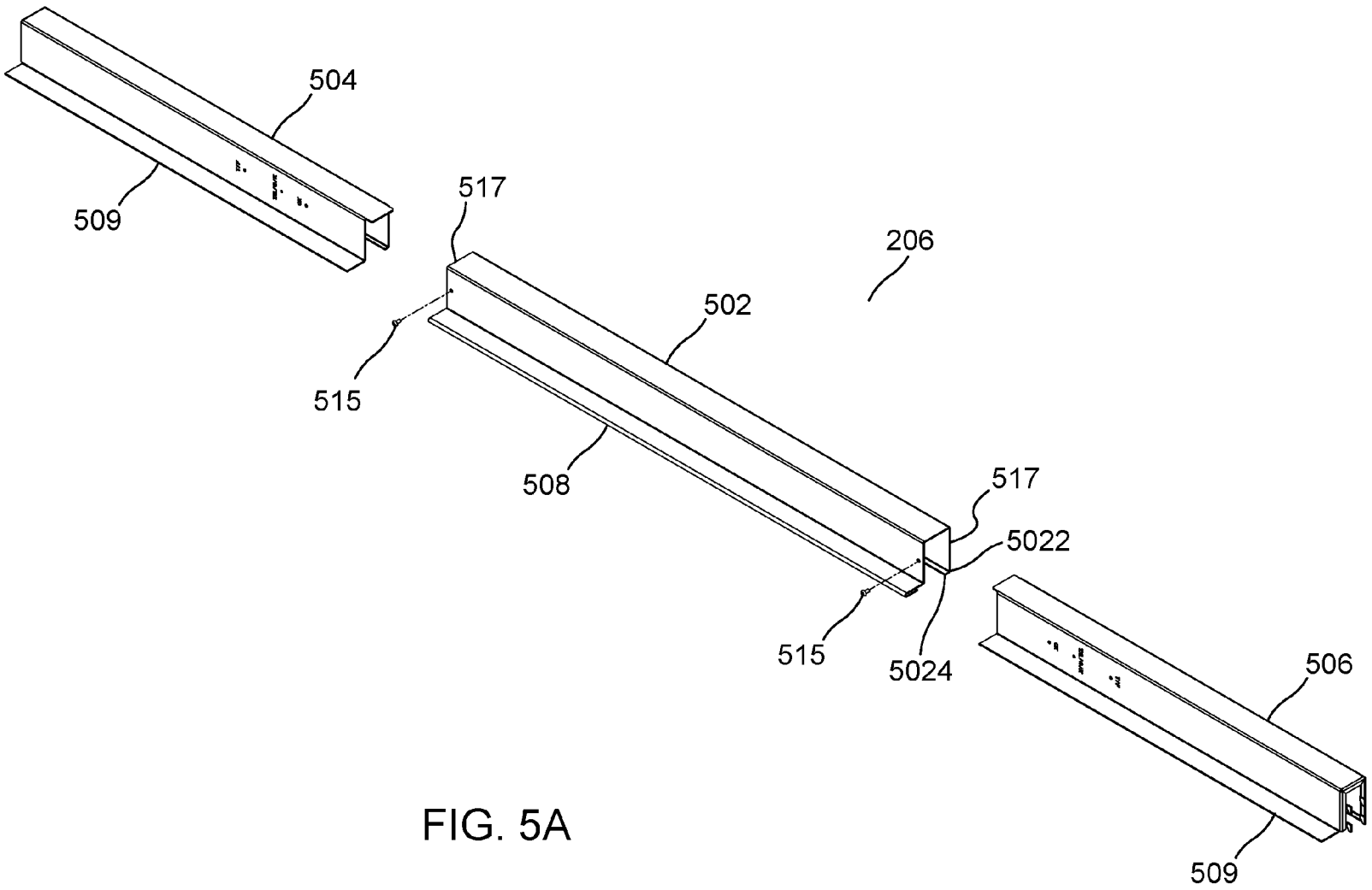
FIG. 5A illustrates an exploded view of a side rail for the adjustable modular frame system of FIG. 2B according to the disclosed embodiments.

Referring to FIG. 5A, the components of side rail 206 are shown. Side rail 206 includes middle side piece 502 having a lip 508 extending inwardly towards a center area enclosed by system 200. Side rail 206 also includes a pair of adjustable side pieces 504 and 506 that fit and move inside middle side piece 502. Adjustable side piece 504 may be referred to as the left adjustable side piece and adjustable side piece 506 may be referred to as the right adjustable side piece. Each adjustable side piece also includes a lip 509.

Side rail 206 includes holes 517 that receive screws 515 to adjust the length of the side rail using adjustable side pieces 504 and 506. Referring to FIG. 5F, markings 520 and holes 522 are shown. One moves adjustable side pieces 504 and 506 to a desired size, such as twin/full, queen/king, or California king, using markings 520. The appropriate hole 522 corresponding to the marking is aligned with hole 517 of middle side piece 502. Screw 515 is placed through holes 517 and 522 to secure the adjustable side piece to the middle side piece. This process is repeated for the other adjustable side piece.

Figure 5B:
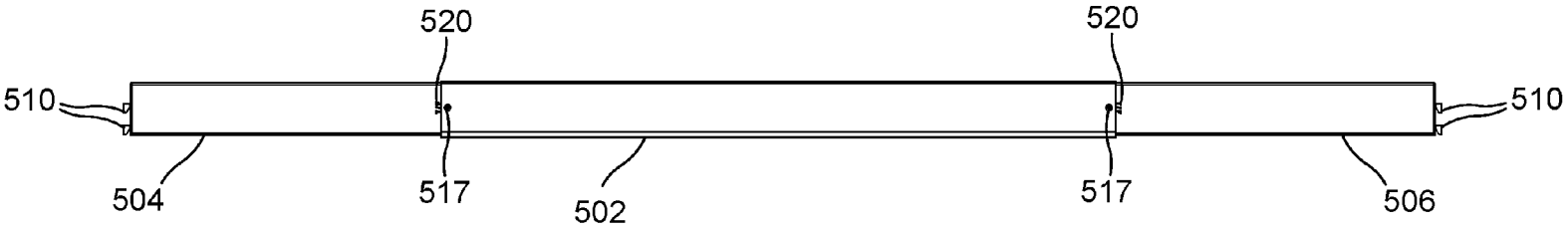
FIG. 5B illustrates a side view of the side rail according to the disclosed embodiments.

FIG. 5B depicts a side view of side rail 206. Mounting projections 510 are included on the ends of adjustable side pieces 504 and 506 opposite middle side piece 502. Like mounting projections 420, mounting projections 510 engage slots 304 and 306 of legs 201 to keep system 200 off of the floor. Preferably, there are four mounting projections 510 for each adjustable side piece 504 and 506. Mounting projections 510 may include a downwardly shaped portion that goes into the slots on legs 201 to mount to the legs. Mounting projections 510 should not dislodge from legs 201 absent some movement of the support rails to do so. Further, markings 520 and holes 517 for adjusting side piece 206 are shown.

Figure 5C:
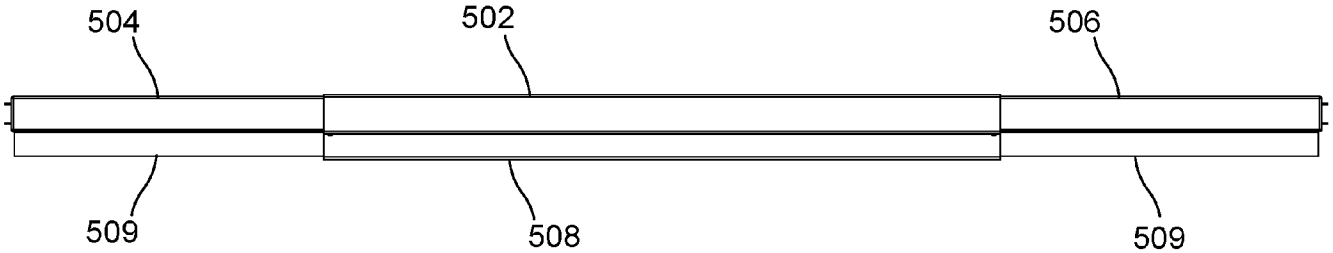
FIG. 5C illustrates a top view of the side rail according to the disclosed embodiments.

FIG. 5C depicts a top view of side rail 206. This figure shows lips 508 and 509 used to support furniture or other items using system 200. Lips 509 may be slightly smaller than lip 508. As adjustable side pieces 504 and 506 move within middle side piece 502, lips 509 are positioned below lip 508. Thus, lip 508 may rest on lips 509. This configuration may prevent buckling of side piece 206 once weight is placed on lips 508 and 509.

Figure 5D:
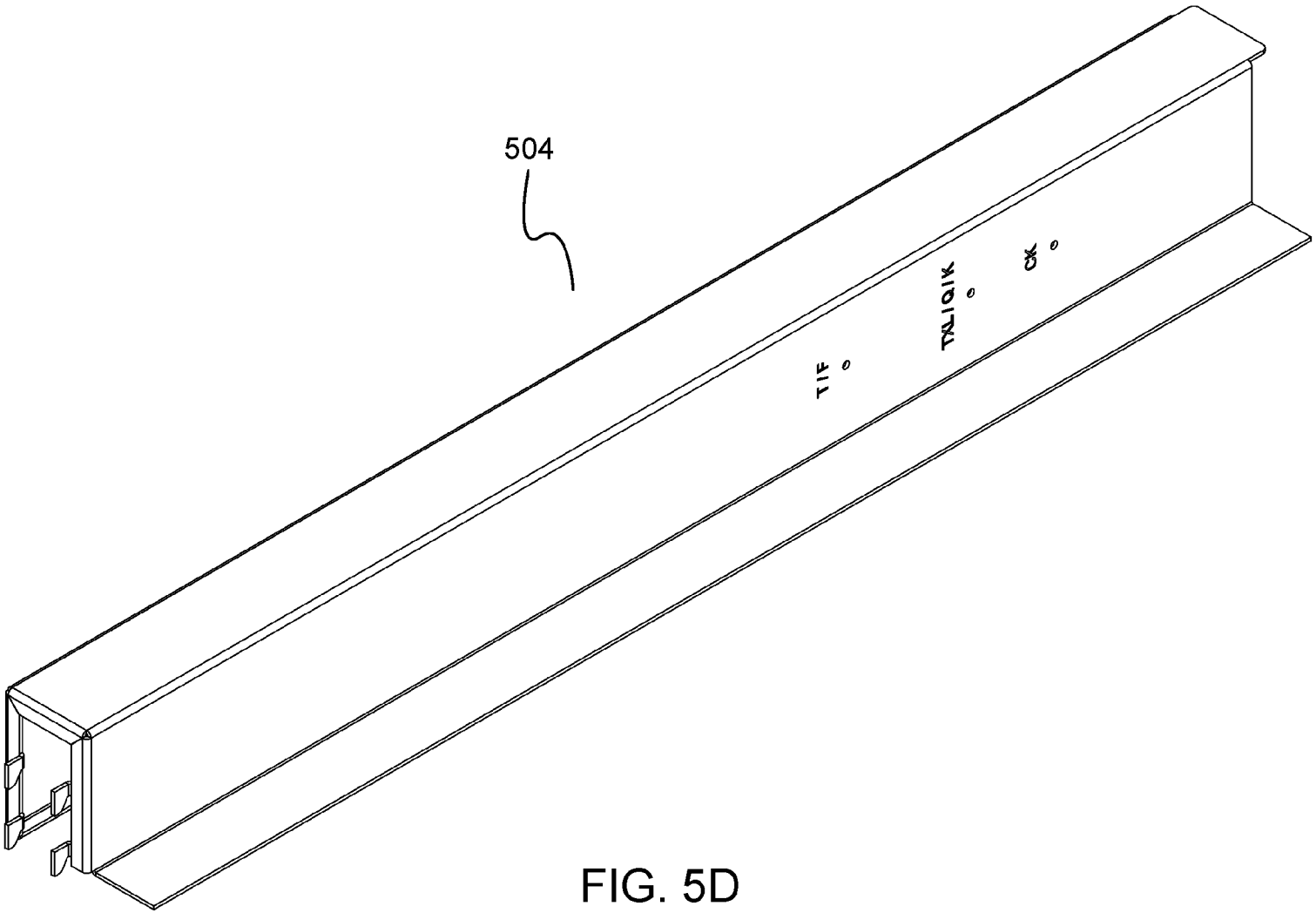
FIG. 5D illustrates a perspective view of an adjustable side piece of the side rail of FIG. 5A according to the disclosed embodiments.
Figure 5E:
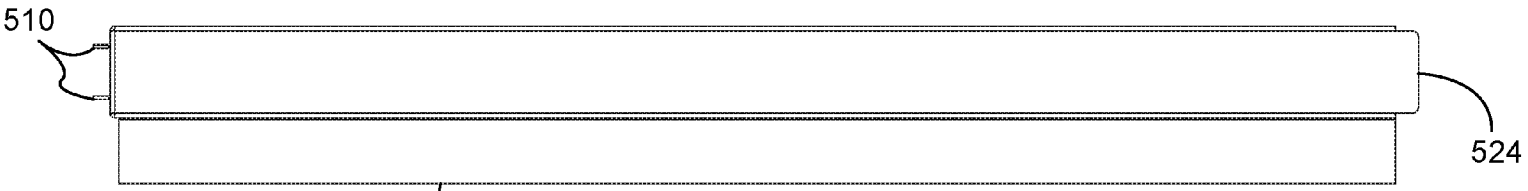
FIG. 5E illustrates a top view of the adjustable side piece according to the disclosed embodiments.
Figure 5F:
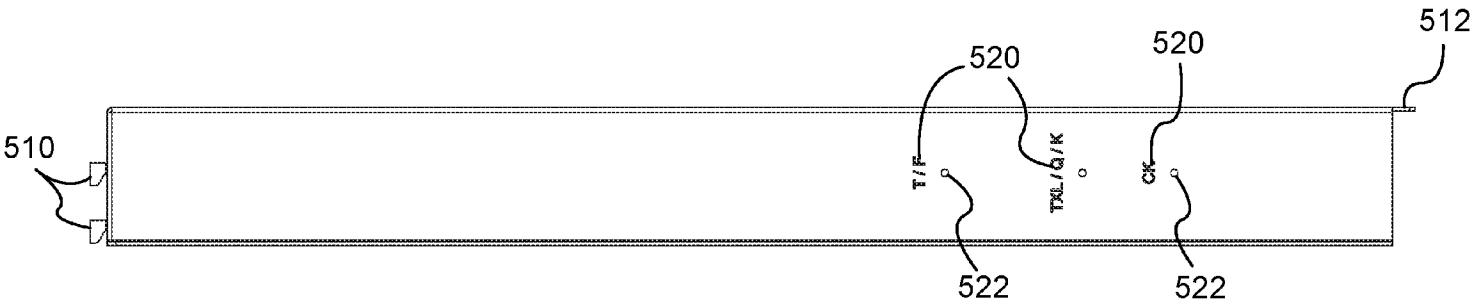
FIG. 5F illustrates a side view of the adjustable side piece according to the disclosed embodiments.
Figure 5G:
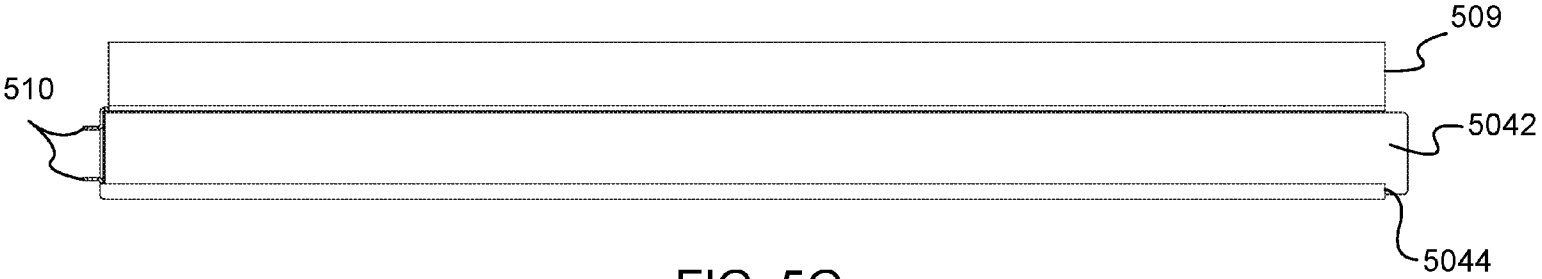
FIG. 5G illustrates a bottom view of the adjustable side piece according to the disclosed embodiments.

FIGS. 5D-G depict more detailed views of adjustable side piece 504 or 506. Adjustable side piece 504 is referred to in the following description for simplicity. FIG. 5D depicts a perspective view of adjustable side piece 504. FIG. 5E depicts a top view, FIG. 5F depicts a side view, and FIG. 5G depicts a bottom view. End 524 of adjustable side piece 504 may be tapered slightly to better fit into middle side piece 502. The bottom side includes channel 5042 and flat section 5044. Flat section 5044 may rest on flat support portion 5022 of middle side piece 502. Thus, middle side piece 502 also includes a channel 5024 on its bottom to allow lip 509 to connect to adjustable side piece 504.

Preferred dimensions for adjustable side piece 504 include a length of about 28 cm to 29 cm. More particularly, the length is about 28.5 cm. A length to the beginning of the tapered portion of end 524 is about 28 cm. Adjustable side piece 504 also may have a width of about 1.5 cm to 2.5 cm, or, more particularly, a width of about 2.0 cm. It also may have a depth of about 2.5 cm to 3.5 cm. More particularly, the depth may be about 3.0 cm to flat section 5044 and 3.03 cm to lip 509. Thus, the side of adjustable side piece 504 having lip 509 is longer than the opposite side. This configuration allows adjustable side piece 504 to fit and move within middle side piece 502. The length of lip 509 may be about 1.5 cm and the length of flat section 5044 may be about 0.875 cm.

FIGS. 6A-E depict center rail 210 of system 200 according to the disclosed embodiments. Referring back to FIG.

2B, center rail 210 fits between top support rail 202 and bottom support rail 204. Center rail 210 also is adjustable to fit the desired configuration of system 200. Center rail 210 includes middle center piece 602 and a pair of connecting pieces 604 and 606 that slidably fit into the middle center piece. Connecting pieces 604 and 606 may move within middle center piece 602 to adjust the length of center rail 210. These components of center rail 210 may vary in thickness to make this component more rigid. In other words, if center rail 210 is made thicker, then it also is more rigid to provide more support.

Figure 6A:
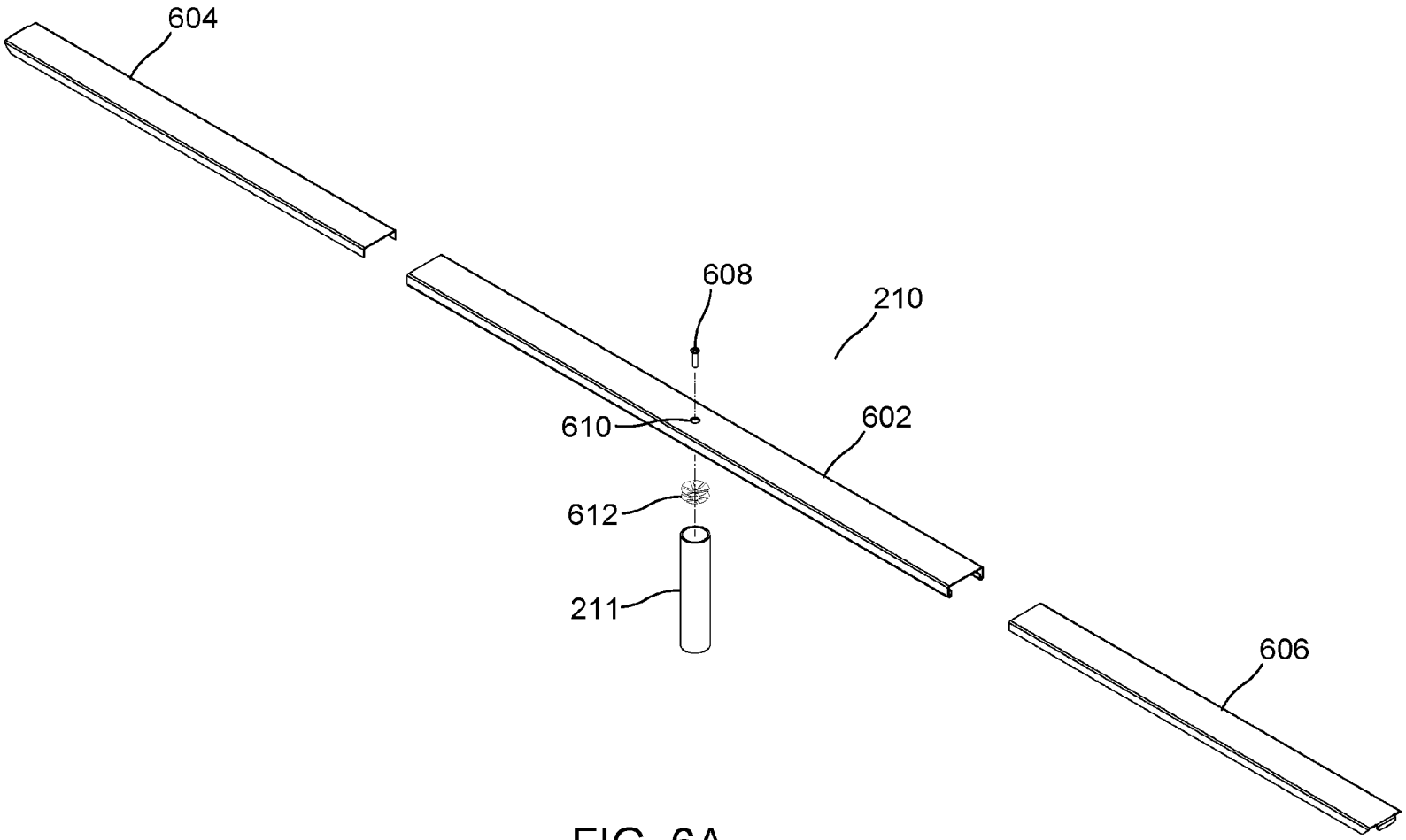
FIG. 6A illustrates an exploded view of a center rail for the adjustable modular frame system of FIG. 2B according to the disclosed embodiments.
Figure 6B:
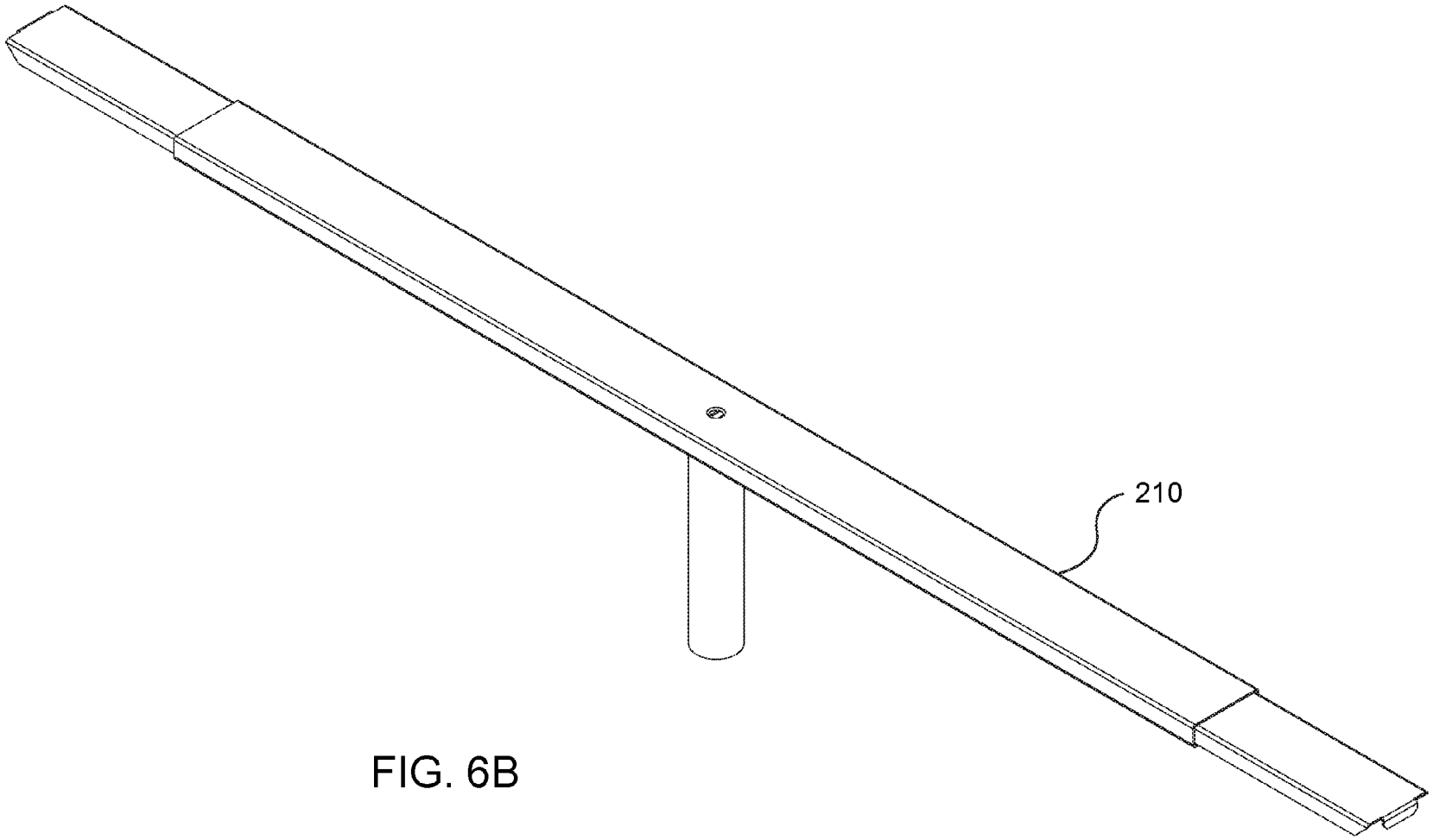
FIG. 6B illustrates a perspective view of the center rail according to the disclosed embodiments.
Figure 6C:
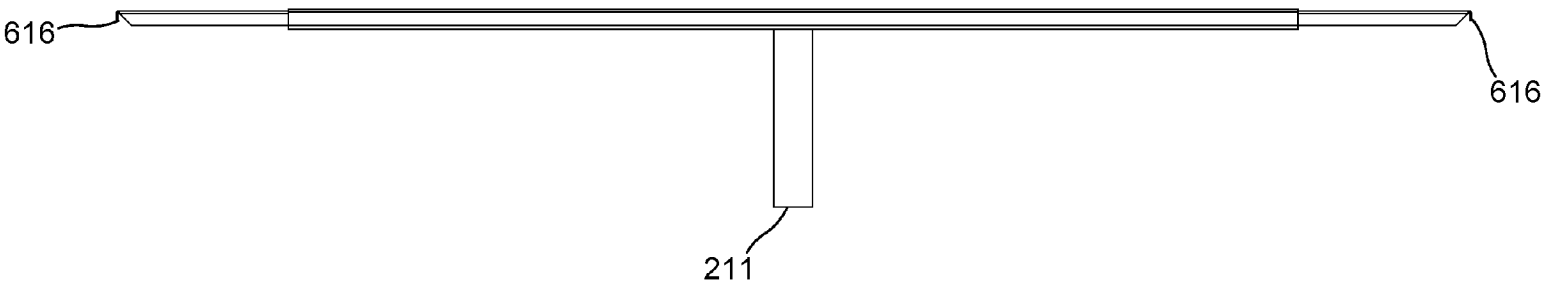
FIG. 6C illustrates a side view of the center rail according to the disclosed embodiments.
Figure 6D:
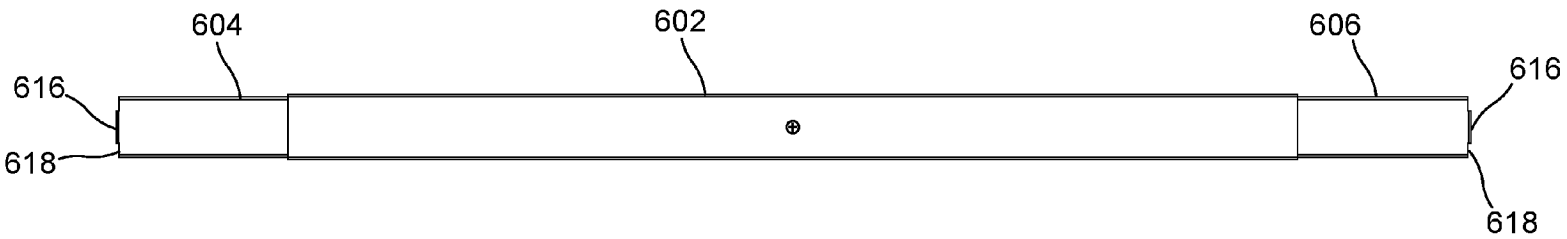
FIG. 6D illustrates a top view of the center rail according to the disclosed embodiments.
Figure 6E:
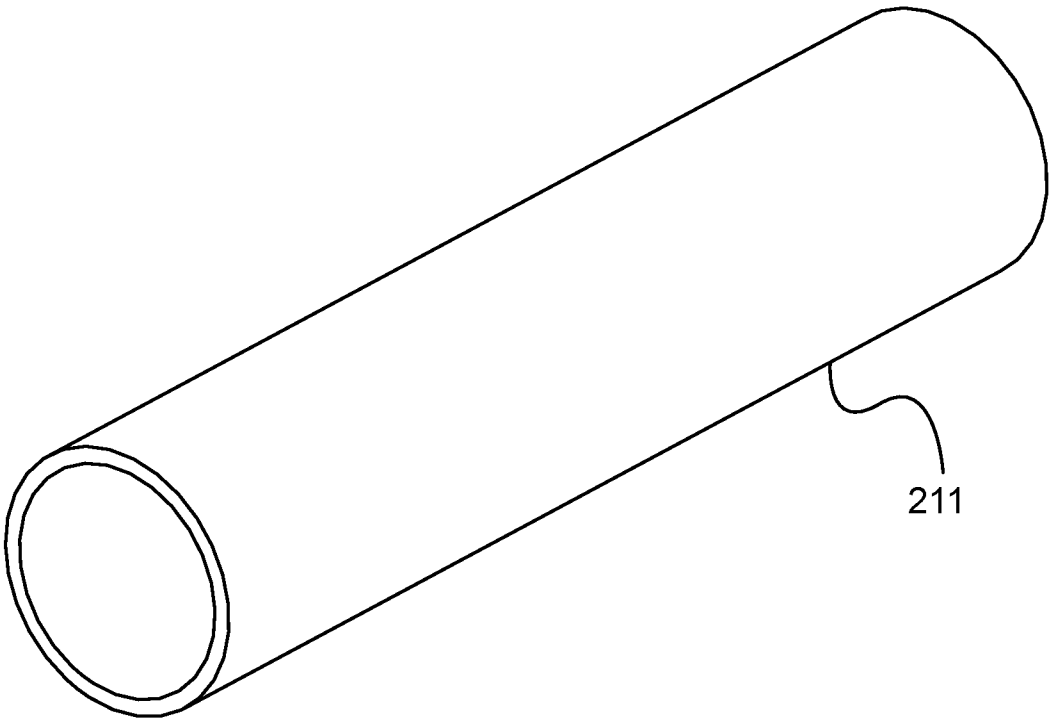
FIG. 6E illustrates a leg piece of the center rail according to the disclosed embodiments.

Middle center piece 602 also connects to leg piece 211. Leg piece 211 provides support to center rail 210 as it does not connect to legs 201. Leg piece 211 prevents center rail from buckling or bending towards the floor, and also provides the necessary clearance underneath any furniture item supported by system 200. Screw 608 inserts through hole 610 to engage washer 612. Washer 612 fits into a top of leg piece 211. Washer 612 also may be referred to as a fitting having a hole to receive screw 608. FIG. 6E shows an example of leg piece 211. Leg piece 211 may be round with a hollow center.

Connecting pieces 604 and 606 then may be placed into middle center piece 602. Connecting pieces 604 and 606 are configured to fit into the midsection of middle center piece 602. As shown, pieces 602, 604, and 606 are thin, substantially flat pieces so that the furniture item can rest on center rail 210 without snagging any material. They also have a rounded top section to not tear or snag material as well as allow for some movement of the furniture item when placed on system 200.

Connecting pieces 604 and 606 each include a tab 616. Tab 616 may be shown in FIGS. 6C and 6D. Tabs 616 are located on ends 618 of connecting pieces 604 and 606. Tabs 616 are placed into slots 408 of support rails 202 and 204. Tabs 616 extend substantially downward to hook into slots 408. Thus, center rail 210 is located substantially in the middle of system 200. Center rail 210 may have a height of about 6.5 cm to 7.2 cm from the top of middle center piece 602 and the bottom of leg piece 211. More particularly, the height may be 6.95 cm.

In some embodiments, more than one center rail 210 may be implemented in system 200. In such a case, middle support piece 402 may include multiple slots 408 to receive tabs 616 from the center rails. Multiple center rails may be desired for a large system 200, or when the furniture item is heavy such that the system needs extra support. Center rail 210 preferably is configured "length-wise" within system 200 but may be configured "width-wise" in that tabs 616 engage slots within middle side piece 502. Alternatively, more than one leg piece 211 may be connected to middle center piece 602 to provide extra support.

Although system 200, as well as system 100, discloses the use of markings and holes that correspond to sizes of beds, the embodiments are not so limited. Any number of holes may be used to adjust the size of system 200. For example, a plurality of holes may be used on adjustable support pieces 404 and 406 as well as adjustable side pieces 504 and 506. These holes may be spaced apart at uniform distances and not according to predetermined sizes. Thus, system 200 may accommodate many different types of furniture configurations beyond beds, such as couches, chairs, and the like. Alternatively, adjustable pieces 404, 406, 504, and 506 may have notches that fit into notches in middle pieces 402 and 502. Each notch may include a hole corresponding to its location so that one may count how many notches for each adjustable piece. Then the screws are fit through the holes to construct system 200.

It will be apparent to those skilled in the art that various modifications to the disclosed golf teaching aid system without departing from the spirit or scope of the invention. Thus, it is intended that the present invention covers the modifications and variations disclosed above provided that these changes come within the scope of the claims and their equivalents.

The invention claimed is:

1. An adjustable modular frame system comprising:

a pair of first corner supports, each first corner support including a pair of rectangular tubes of different lengths connected to a leg, wherein a first rectangular tube is connected to a U-channel insert and a second rectangular tube is connected to a support insert;

a pair of second corner supports, each second corner support including a pair of rectangular tubes of different lengths connected to a leg, wherein a first rectangular tube is connected to the support insert, and a second rectangular tube is connected to the U-channel insert, and wherein the second rectangular tube of the second corner support is longer than the first rectangular tube of the first corner support; and a pair of T-section supports connected to a center bar having a leg, the pair of T-section supports connected to the support insert such that each T-section support is coupled to the second rectangular tube of a first corner support and the first rectangular tube of a second corner support, wherein the pair of first corner supports, the pair of second corner supports, and the pair of T-section supports are adjustable in distance from each other using one or more additional U-channel inserts or support inserts.

2. The adjustable modular frame system of claim 1, wherein the U-channel insert includes a track.

3. The adjustable modular frame system of claim 1, wherein each of the T-section supports includes an upper part and a lower part, and further wherein the lower part engages the center bar.

4. The adjustable modular frame system of claim 1, wherein each of the T-section supports includes a track.

5. The adjustable modular frame system of claim 4, wherein the center bar includes at least one adapter to engage the track of the T-section supports.

6. An adjustable modular frame system comprising:

a plurality of legs placed in each corner of the system;

a pair of support rails located opposite each other, wherein each support rail includes a middle support piece having a channel on a bottom side, the channel bounded by a bent portion and a flat support portion, the bent portion extending inwardly into the middle support piece, wherein the middle support piece includes a slot located approximately midsection, and a pair of adjustable support pieces movable within the middle support piece to adjust a length of the support rail, wherein each adjustable support piece fits into the middle support piece such that a side of the adjustable support piece engages the bent portion of the middle support piece, and further wherein each adjustable support piece includes a flatbar having two holes therein to overlap a leg of the plurality of legs;

a pair of side rails located opposite each other, wherein each side rail includes a middle side piece having a lip extending inwardly to the system, wherein the middle side piece includes a channel on a bottom side, and a pair of adjustable side pieces movable within the middle side piece to adjust a length of the side rail, wherein each adjustable side piece has a lip extending inwardly to the system and further wherein the pair of adjustable side pieces connect to legs of the plurality of legs, wherein the lip of the middle side piece and the lips of the adjustable side pieces are aligned; and a center rail to connect to the pair of support rails, wherein the center rail includes a middle center piece connected to a leg piece, and a pair of connecting pieces to slidably fit into the middle center piece, wherein each connecting piece includes a tab on an end opposite the middle center piece, the tab to fit into the slot of the middle support piece of the support rail, wherein the pair of connecting pieces move within the middle center piece to adjust a length of the center rail.

7. The adjustable modular frame system of claim 6, wherein a length of the leg piece is smaller than a length of a leg of the plurality of legs.

8. The adjustable modular frame system of claim 6, wherein the middle center piece and the pair of connecting pieces are substantially flat.

9. The adjustable modular frame system of claim 6, wherein each of the pair of adjustable support pieces include mounting projections at an end thereof.

10. The adjustable modular frame system of claim 9, wherein the mounting projections fit into slots within the leg of the plurality of legs.

11. The adjustable modular frame system of claim 6, wherein each of the pair of adjustable side pieces include mounting projections at an end thereof.

12. The adjustable modular frame system of claim 11, wherein the mounting projections fit into slots within the leg of the plurality of legs.

13. The adjustable modular frame system of claim 6, wherein the lip for each adjustable side piece fits underneath the lip for the middle side piece.

14. The adjustable modular frame system of claim 6, wherein middle side piece includes a channel on a bottom side thereof such that a side of the adjustable side piece connects to the lip of the adjustable side piece within the channel.

15. The adjustable modular frame system of claim 6, wherein the middle support piece includes a pair of holes on each end thereof, and further wherein the pair of holes align with a hole in each of the pair of adjustable support pieces that correspond to a marking associated with a size for the system.

16. An adjustable modular frame system comprising:

a pair of support rails, each support rail having a middle support piece and a pair of adjustable support pieces movable within the middle support piece, wherein each of the pair of adjustable support pieces fit into a bent portion and a flat support portion of the middle support piece;

a pair of side rails, each side rail having a middle side piece with a first lip and a pair of adjustable side pieces with second lips, the pair of adjustable side pieces movable within the middle side piece, wherein the second lips of the pair of adjustable side pieces fit underneath the first lip of the middle side piece;

a center rail having a middle center piece connected to a leg piece and a pair of connecting pieces movable within the middle center piece, wherein each of the pair of connecting pieces includes a tab to connect to a slot in the middle support piece; and a plurality of legs, each leg coupled to an adjustable support piece and an adjustable side piece, wherein the pair of adjustable support pieces and the pair of adjustable side pieces, along with the pair of the connecting pieces are configurable to a desired size.

17. The adjustable modular frame system of claim 16, wherein the each leg includes slots on two sides of the leg to engage mounting projections on the adjustable support piece and mounting projections of the adjustable side piece.

18. The adjustable modular frame system of claim 16, wherein the middle support piece includes a channel between the bent portion and the flat support portion.

19. The adjustable modular frame system of claim 16, further comprising a flatbar within each of the pair of adjustable support pieces.

* * * * *